US007745384B2

(12) United States Patent
Perry et al.

(10) Patent No.: US 7,745,384 B2
(45) Date of Patent: Jun. 29, 2010

(54) ACIDIC HARD SURFACE CLEANING COMPRISING AN ETHOXYLATED QUATERNARY AMMONIUM/AMINE SURFACTANT MIXTURE

(75) Inventors: Lisa Perry, Beverly (GB); James Young, Harrogate (GB)

(73) Assignee: Reckitt Benckiser (UK) Limited, Slough, Berkshire (GB)

( * ) Notice: Subject to any disclaimer, the term of this patent is extended or adjusted under 35 U.S.C. 154(b) by 0 days.

(21) Appl. No.: 12/063,738

(22) PCT Filed: Jul. 18, 2007

(86) PCT No.: PCT/GB2007/002714

§ 371 (c)(1),
(2), (4) Date: Feb. 13, 2008

(87) PCT Pub. No.: WO2008/015381

PCT Pub. Date: Feb. 7, 2008

(65) Prior Publication Data

US 2009/0197786 A1 Aug. 6, 2009

Related U.S. Application Data

(60) Provisional application No. 60/820,853, filed on Jul. 31, 2006.

(51) Int. Cl.

| | |
|---|---|
| ***C11D 1/835*** | (2006.01) |
| ***C11D 1/72*** | (2006.01) |
| ***C11D 1/62*** | (2006.01) |
| ***C11D 7/08*** | (2006.01) |

(52) U.S. Cl. ..... 510/253; 510/235; 510/237; 510/356; 510/384; 510/421; 510/422; 510/477; 510/499; 510/504

(58) Field of Classification Search ..... 510/235, 510/237, 253, 356, 421, 422, 477, 499, 504, 510/384

See application file for complete search history.

(56) References Cited

U.S. PATENT DOCUMENTS

| | | | | |
|---|---|---|---|---|
| 5,462,697 | A * | 10/1995 | Yianakopoulos | 510/101 |
| 5,958,852 | A * | 9/1999 | Yianakopoulos et al. | 510/191 |
| 6,159,925 | A * | 12/2000 | Blandiaux | 510/437 |
| 6,239,092 | B1 * | 5/2001 | Papasso et al. | 510/238 |
| 6,632,784 | B2 * | 10/2003 | Massaux et al. | 510/417 |
| 2003/0109395 | A1 * | 6/2003 | Neumiller | 510/246 |
| 2005/0020471 | A1 * | 1/2005 | Cheung et al. | 510/463 |
| 2005/0043204 | A1 * | 2/2005 | Barnabas et al. | 510/470 |
| 2005/0215447 | A1 * | 9/2005 | Evers et al. | 510/238 |
| 2006/0100128 | A1 * | 5/2006 | McCue et al. | 510/506 |
| 2006/0111261 | A1 * | 5/2006 | Sadlowski et al. | 510/221 |
| 2006/0194709 | A1 * | 8/2006 | Boone et al. | 510/383 |
| 2006/0281662 | A1 * | 12/2006 | Cheung et al. | 510/504 |
| 2006/0287209 | A1 * | 12/2006 | Chaigne et al. | 510/238 |
| 2007/0105737 | A1 * | 5/2007 | Dastbaz et al. | 510/238 |
| 2008/0139443 | A1 * | 6/2008 | Buzinski et al. | 510/362 |
| 2008/0227682 | A1 * | 9/2008 | Feng et al. | 510/414 |

FOREIGN PATENT DOCUMENTS

| | | | |
|---|---|---|---|
| EP | 1362907 | A | 11/2003 |
| GB | 2341870 | A | 3/2000 |
| WO | 03102119 | A1 | 12/2003 |

OTHER PUBLICATIONS

Berol 260, 266, 840, Ethylan 1005: Narrow range Ethoxylated Alcohols. Cleaning & Biocides, [Online] XP002454948 Retrieved from the Internet: URL:http://www.surfactants.akzonobel.com/bulletins/Berol%20260,% 20266,%20840,%20Ethylan%201005%20-%20Narrow%2Orange%20Ethoxylayed%20Alcohols.pdf> [retrieved on Oct. 15, 2007] dated Sep. 2005.

Household, Institutional & Industrial Cleaners, Anonymous, Publication SC02-02, 2002 Akzo Nobel Surface Chemistry LLC.

Emulsions and Solubilization, Shinoda, K. et al., John Wiley & Sons, Inc., 1986.

* cited by examiner

*Primary Examiner*—Charles I Boyer
(74) *Attorney, Agent, or Firm*—Norris McLaughlin & Marcus, PA

(57) ABSTRACT

The present invention relates to hard surface cleaning compositions useful in cleaning, and optionally a disinfecting or sanitizing benefit which are particularly adapted to clean lavatory appliances, particularly toilets and the like. The compositions are largely aqueous, thickened, acidic compositions which comprise an acid, a thickening constituent or constituents which form a thickener system, at least one detersive surfactant and at least one superwetter surfactant which is based on a narrow range ethoxylated alcohol nonionic surfactant having two cloud points.

5 Claims, No Drawings

ACIDIC HARD SURFACE CLEANING COMPRISING AN ETHOXYLATED QUATERNARY AMMONIUM/AMINE SURFACTANT MIXTURE

This is an application under 35 USC 371 of PCT/GB2007/002714.

The present invention relates generally to hard surface cleaning compositions useful in cleaning, and optionally a disinfecting or sanitizing benefit to hard surfaces. More particularly the present invention relates to hard surface cleaning compositions useful in cleaning, and optionally a disinfecting or sanitizing benefit which are particularly adapted to clean lavatory appliances, particularly toilets and the like.

While the art is replete with hard surface cleaning compositions which are effective in the cleaning of a variety of stains which are frequently encountered in lavatories and bathrooms, e.g., limescale stains, soap scum stains and organic soils, the effective cleaning of lavatory appliances, e.g., toilets, requires that effective coverage of surfaces intended to be treated with the composition occur in order to ensure that contact between a cleaning composition and the stains present on the surface occur. Without such contact, ineffective cleaning is to be expected. With regard to compositions which are used in the cleaning of toilets, a particular problem is that while it is advantageous to utilize a composition which is viscous in order to provide good coverage and retention on an inclined surface, e.g., the interior of a toilet bowl, in need of a cleaning treatment, the use of such viscous compositions as dispensed from a squeeze bottle is not without problems. Frequently, a user is directed to supply a generally uniform quantity of a cleaning composition to the interior of a toilet bowl, such as by simultaneously squeezing a bottle containing such a composition while expelling its contents out from a nozzle in order to apply it underneath the upper rim of a toilet bowl. While such an operation is effective in the delivery of a quantity of the cleaning composition to the sidewall of a toilet bowl, with prior art compositions it is almost universally observed that as the layer, or lamina of applied liquid slowly descends towards the bottom of the interior of the toilet bowl, the lamina almost always separates into a plurality of discrete downwardly extending regions of the cleaning composition, referred to as "fingers", which once formed form channels through which the applied compositions prefer to flow downwardly. These fingers also define zones or regions of the interior surface of the toilet bowl which are intermediate adjacent fingers which is uncoated by the cleaning composition and thus remains untreated. In order to ensure good coverage, either reapplication of a further amount of the cleaning composition and/or user intervention, e.g., the use of a toilet brush in order to physically spread the cleaning composition to the uncoated zones or regions is required. Both of these alternatives are directed to overcoming shortcomings of the flow profile of the lamina of falling cleaning composition applied to the toilet bowl but both alternatives are not without their shortcomings. In the case of the former, the need to reapply the cleaning composition is wasteful of the cleaning composition which may have been amply effective if it had been more effective in providing a more even coating of the interior surface of the toilet bowl. In the case of the latter, manual intervention is not favored by consumers in all instances and additionally may cause an uneven layer, or for that matter a layer of a cleaning composition to be applied which is undesirably diluted when a wet toilet brush is used. Additionally the use of a toilet brush, with bristles having sharp ends, also scrapes the applied cleaning composition from the interior wall of the toilet bowl. Such only further detracts from the potential cleaning efficacy of the cleaning composition had it been possible to more effectively apply it to the interior sidewalls of the toilet bowl.

While compositions are known to the art which provide a cleaning and optionally a disinfecting benefit to hard surfaces and particularly to lavatory appliances there is nonetheless a real and continuing need in the art to provide still further improved compositions which provide an improved cleaning, and desirably also a simultaneous sanitizing or disinfecting benefit to treated hard surfaces. Particularly there is a real need in the art for liquid cleaning compositions useful in the treatment of hard surfaces which feature improved surface coverage when applied from a container, especially a squeeze bottle onto a vertical or inclined hard surface.

Accordingly, it is among the objects of the invention to provide improved cleaning compositions which provide the benefits of good cleaning to a treated hard surface, and especially to provide feature improved surface coverage when applied from a container, especially a squeeze bottle onto a vertical or inclined hard surface. In certain preferred embodiments the inventive compositions may also provide a useful sanitizing or disinfecting benefit to treated surfaces A yet further object of the invention is to provide a readily pourable and readily pumpable cleaning composition which features the benefits described above.

According to a still further object of the invention there is provided a method for the cleaning of hard surfaces, particularly lavatory appliances and especially such surfaces and appliance surfaces which are vertical or inclined which method contemplates the use of the compositions of the present invention in order to provide an improved delivery and/or cleaning benefit.

These and other objects of the invention are disclosed in the following specification.

The compositions of the invention are largely aqueous, thickened, acidic compositions which exhibit a pH of about 4 or less, and comprise an acid, a thickening constituent or constituents which form a thickener system, at least one detersive surfactant and at least one superwetter surfactant which is based on a nonionic surfactant, a narrow range ethoxylated alcohol having two cloud points. The compositions of the invention may comprise further constituents to those indicated immediately above which are optionally included in order to provide an additional benefit to the composition, e.g. a technical or aesthetic benefit.

The compositions of the invention are acidic in nature and comprise at least one inorganic and/or organic acid in a sufficient amount in order that the compositions of the invention are at a pH of 4 or less, and increasingly preferably in the order of the following sequence, have a pH of 3.8, 3.5, 3.25, 3.0, 2.75, 2.5, 2.25, 2, 1.75, 1.5, 1.25, 1 and especially preferably 0.9, 0.8, 0.7, 0.6, 0.5, 0.4, 0.3, 0.2, 0.1 and even 0.

Exemplary useful in inorganic acids include: sulfuric acid, phosphoric acid, potassium dihydrogenphosphate, sodium dihydrogenphosphate, sodium sulfite, potassium sulfite, sodium pyrosulfite (sodium metabisulfite), potassium pyrosulfite (potassium metabisulfite), acid sodium hexametaphosphate, acid potassium hexametaphosphate, acid sodium pyrophosphate, acid potassium pyrophosphate, hydrochloric acid, and sulfamic acid. Other water dispersible or water soluble inorganic or mineral acids not specifically eludicated herein but which nonetheless may be found effective in the inventive compositions.

Exemplary useful organic acids include any known art organic acid which may be found effective in the inventive compositions. Generally useful organic acids are those which include at least one carbon atom, and include at least one carboxyl group (—COOH) in its structure. Preferred are water soluble organic acids which contain from 1 to about 6 carbon atoms, and at least one carboxyl group as noted and exemplary useful organic acids include: linear aliphatic acids such as formic acid, acetic acid, propionic acid, butyric acid and valeric acid; dicarboxylic acids such as oxalic acid, malonic acid, succinic acid, glutaric acid, adipic acid, pimelic acid, fumaric acid and maleic acid; acidic amino acids such as glutamic acid and aspartic acid; and hydroxy acids such as glycolic acid, lactic acid, hydroxyacrylic acid, alpha-hydroxybutyric acid, glyceric acid, tartronic acid, malic acid, tartaric acid and citric acid, as well as acid salts of these organic acids.

Preferred examples of the organic acid to be used in the present invention include linear aliphatic acids such as formic acid, acetic acid, propionic acid, butyric acid and valeric acid; dicarboxylic acids such as oxalic acid, malonic acid, succinic acid, glutaric acid, adipic acid, pimelic acid, fumaric acid and maleic acid; acidic amino acids such as glutamic acid and aspartic acid; and hydroxy acids such as glycolic acid, lactic acid, hydroxyacrylic acid, alpha-hydroxybutyric acid, glyceric acid, tartronic acid, malic acid, tartaric acid and citric acid, as well as acid salts of these organic acids. Preferred useful organic acids include citric acid, cresylic acid, dodecylbenzene sulfonic acid, phosphoric acid, salicylic acid, sorbic acid, sulfamic acid, acetic acid, benzoic acid, boric acid, capric acid, caproic acid, cyanuric acid, dihydroacetic acid, dimethylsulfamic acid, polyacrylic acid, 2-ethyl-hexanoic acid, fumaric acid, I-glutamic acid, isopropyl sulfamic acid, naphthenic acid, oxalic acid, phosphorous acid, valeric acid, benzene sulfonic acid, xylene sulfonic acid, sulfonic acids, maleic acid, acetic acid, adipic acid, formic acid, lactic acid, butyric acid, gluconic acid, malic acid, tartaric acid, as well as glycolic acid.

These acids can be used singly or as a mixture of two or more. While they may be present in any effective amount in order to attain a desired acidic pH, advantageously they are present in an amount of from about 0.001-15% wt., and more preferably from 0.001-10% wt. based on the total weight of the compositions of which they form a part.

In certain preferred embodiments of the invention the sole acids present are one or more of: citric acid, formic acid and/or hydrochloric acid to the exclusion of other acids.

In certain preferred embodiments of the invention the sole acids present are one or more of: citric acid, and formic to the exclusion of other acids, and preferably in such embodiments both citric and formic acid are both present to the exclusion of other acids.

The compositions of the invention include at least one detersive surfactant. Such detersive surfactants may be selected from anionic, nonionic, cationic, amphoteric as well as zwitterionic surfactants.

Generally any anionic surfactant material may be used in the inventive compositions as a detersive surfactant. By way of non-limiting example, suitable anionic surfactants include: alkali metal salts, ammonium salts, amine salts, or aminoalcohol salts of one or more of the following compounds (linear and secondary): alcohol sulfates and sulfonates, alcohol phosphates and phosphonates, alkyl sulfates, allyl ether sulfates, sulfate esters of an alkylphenoxy polyoxyethylene ethanol, alkyl monoglyceride sulfates, alkyl sulfonates, olefin sulfonates, paraffin sulfonates, beta-alkoxy alkane sulfonates, alkylamidoether sulfates, alkylaryl polyether sulfates, monoglyceride sulfates, alkyl ether sulfonates, ethoxylated alkyl sulfonates, alkylaryl sulfonates, alkyl benzene sulfonates, alkylamide sulfonates, allyl monoglyceride sulfonates, alkyl carboxylates, alkyl sulfoacetates, alkyl ether carboxylates, alkyl alkoxy carboxylates having 1 to 5 moles of ethylene oxide, alkyl sulfosuccinates, alkyl ether sulfosuccinates, alkylamide sulfosuccinates, alkyl sulfosuccinamates, octoxynol or nonoxynol phosphates, alkyl phosphates, alkyl ether phosphates, taurates, N-acyl taurates, fatty taurides, fatty acid amide polyoxyethylene sulfates, isethionates, acyl isethionates, and sarcosinates, acyl sarcosinates, or mixtures thereof. Generally, the alkyl or acyl radical in these various compounds comprise a carbon chain containing 12 to 20 carbon atoms.

Preferred anionic surfactants include alkyl sulfates which may be represented by the following general formula:

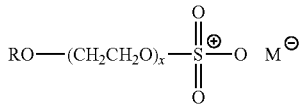

wherein R is an straight chain or branched allyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium, or is ammonium or substituted ammonium cation, and x is from 0 to about 4. Of these, most preferred are the non-ethoxylated $C_{12}$-$C_{15}$ primary and secondary alkyl sulfates.

Exemplary commercially available alkyl sulfates include one or more of those available under the tradenames RHODAPON® (ex. Rhône-Poulenc Co.) as well as STEPANOL® (ex. Stepan Chemical Co.). Exemplary alkyl sulfates which is preferred for use is a sodium lauryl sulfate surfactant presently commercially available as RHODAPON® LCP (ex. Rône-Poulenc Co.), as well as a further sodium lauryl sulfate surfactant composition which is presently commercially available as STEPANOL® WAC (ex. Stepan Chemical Co.).

Further preferred anionic include allyl sulfonate anionic surfactants which may be represented according to the following general formula:

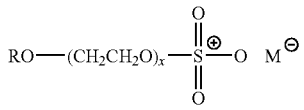

wherein R is an straight chain or branched alkyl chain having from about 8 to about 18 carbon atoms, saturated or unsaturated, and the longest linear portion of the allyl chain is 15 carbon atoms or less on the average, M is a cation which makes the compound water soluble especially an alkali metal such as sodium, or is ammonium or substituted ammonium cation, and x is from 0 to about 4. Most preferred are the $C_{12}$-$C_{15}$ primary and secondary alkyl sulfates.

Exemplary commercially available alkane sulfonate surfactants include one or more of those available under the tradename HOSTAPUR® (ex. Clariant). An exemplary and particularly alkane sulfonate which is preferred for use is a secondary sodium alkane sulfonate surfactant presently commercially available as HOSTAPUR® SAS from Hoechst Celanese.

Exemplary useful sarcosinate surfactants include alkali metal salts of N-alkyl-N-acyl amino acids. These are salts derived from the reaction of (1) N-alkyl substituted amino acids of the formula:

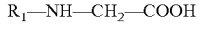

where $R_1$ is a linear or branched chain lower alkyl of from 1 to 4 carbon atoms, especially a methyl, for example, aminoacetic acids such as N-methylaminoacetic acid (i.e. N-methyl glycine or sarcosine), N-ethyl-aminoacetic acid, N-butylaminoacetic acid, etc., with (2) saturated natural or synthetic fatty acids having from 8 to 18 carbon atoms, especially from 10 to 14 carbon atoms, e.g. lauric acid, and the like.

The resultant reaction products are salts which may have the formula:

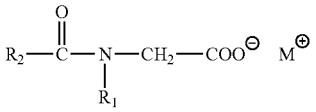

where M is an alkali metal ion such as sodium, potassium or lithium; $R_1$ is as defined above; and wherein $R_2$ represents a hydrocarbon chain, preferably a saturated hydrocarbon chain, having from 7 to 17 carbon atoms, especially 9 to 13 carbon atoms of the fatty acyl group

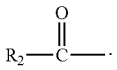

Exemplary useful and preferred sarcosinate surfactants include cocoyl sarcosinate, lauroyl sarcosinate, myristoyl sarcosinate, palmitoyl sarcosinate, stearoyl sarcosinate and oleoyl sarcosinate, and tallow sarcosinate. Such materials are also referred to as N-acyl sarcosinates.

Generally any nonionic surfactant material may be used in the inventive compositions. Practically any hydrophobic compound having a carboxy, hydroxy, amido, or amino group with a free hydrogen attached to the nitrogen can be condensed with an alkylene oxide, especially ethylene oxide or with the polyhydration product thereof, a polyalkylene glycol, especially polyethylene glycol, to form a water soluble or water dispersible nonionic surfactant compound. By way of non-limiting example, particularly examples of suitable nonionic surfactants which may be used in the present invention include the following:

One class of useful nonionic surfactants include polyalkylene oxide condensates of alkyl phenols. These compounds include the condensation products of alkyl phenols having an allyl group containing from about 6 to 12 carbon atoms in either a straight chain or branched chain configuration with an alkylene oxide, especially an ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

A further class of useful nonionic surfactants include the condensation products of aliphatic alcohols with from about 1 to about 60 moles of an alkylene oxide, especially an ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5, which is described in product literature from Sasol as a C8-10 having an average molecular weight of 356, an ethylene oxide content of about 4.85 moles (about 60 wt. %), and an HLB of about 12; Alfonic® 810-2, which is described in product literature as a $C_8$-$C_{10}$ having an average molecular weight of 242, an ethylene oxide content of about 2.1 moles (about 40 wt. %), and an HLB of about 12; and Alfonic® 610-3.5, which is described in product literature as having an average molecular weight of 276, an ethylene oxide content of about 3.1 moles (about 50 wt. %), and an HLB of 10. Other examples of alcohol ethoxylates are C10 oxo-alcohol ethoxylates available from BASF under the Lutensol® ON tradename. They are available in grades containing from about 3 to about 11 moles of ethylene oxide (available under the names Lutensol® ON 30; Lutensol® ON 50; Lutensol® ON 60; Lutensol® ON 65; Lutensol® ON 66; Lutensol® ON 70; Lutensol® ON 80; and Lutensol® ON 110). Other examples of ethoxylated alcohols include the Neodol® 91 series nonionic surfactants available from Shell Chemical Company which are described as $C_9$-$C_{11}$ ethoxylated alcohols. The Neodol® 91 series non-ionic surfactants of interest include Neodol® 91-2.5, Neodol® 91-6, and Neodol® 91-8. Neodol® 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Further examples of ethoxylated alcohols include the Rhodasurf® DA series non-ionic surfactants available from Rhodia which are described to be branched isodecyl alcohol ethoxylates. Rhodasurf® DA-530 has been described as having 4 moles of ethoxylation and an HLB of 10.5; Rhodasurf® DA-630 has been described as having 6 moles of ethoxylation with an HLB of 12.5; and Rhodasurf® DA-639 is a 90% solution of DA-630. Further examples of ethoxylated alcohols include those from Tomah Products (Milton, Wis.) under the Tomadol® tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear $C_9/C_{10}/C_{11}$ and n is 2.5, 6, or 8; 1-3; 1-5; 1-7; 1-73B; 1-9; where R is linear $C_{11}$ and n is 3, 5, 7 or 9; 23-1; 23-3; 23-5; 23-6.5—where R is linear $C_{12}/C_{13}$ and n is 1, 3, 5, or 6.5; 25-3; 25-7; 25-9; 25-12—where R is linear $C_{12}/C_{13}/C_{14}/C_{15}$ and n is 3, 7, 9, or 12; and 45-7; 45-13—where R is linear $C_{14}/C_{15}$ and n is 7 or 13.

A further class of useful nonionic surfactants include primary and secondary linear and branched alcohol ethoxylates, such as those based on $C_6$-$C_{18}$ alcohols which further include an average of from 2 to 80 moles of ethoxylation per mol of alcohol. These examples include the Genapol® UD (ex. Clariant, Muttenz, Switzerland) described under the tradenames Genapol® UD 030, $C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol® UD 080, $C_{11}$-oxo-alcohol polyglycol ether with 8 EO; Genapol® UD 088, $C_{11}$-oxo-alcohol polyglycol ether with 8 EO; and Genapol® UD 110, $C_1$-oxo-alcohol polyglycol ether with 11 EO.

A further class of useful nonionic surfactants include those surfactants having a formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from about 1 to about 12. Surfactants of this formula are presently marketed under the Genapol® tradename (ex. Clariant), which surfactants include the "26-L" series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1, 26-L-1.6, 26-L-2, 26-L-3, 26-L-5, 26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3, 24-L-45, 24-L-50, 24-L-60, 24-L-60N, 24-L-75, 24-L-92, and 24-L-98N, all sold under the Genapol® tradename.

A further class of useful nonionic surfactants include alkoxy block copolymers, and in particular, compounds based on ethoxy/propoxy block copolymers. Polymeric alkylene oxide block copolymers include nonionic surfactants in which the major portion of the molecule is made up of block polymeric $C_2$-$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula (A):

$$HO\text{-}(EO)_x(PO)_y(EO)_z\text{-}H \quad (A)$$

where EO represents ethylene oxide,

PO represents propylene oxide, y equals at least 15, $(EO)_{x+y}$ equals 20 to 50% of the total weight of said compounds, and, the total molecular weight is preferably in the range of about 2000 to 15,000. These surfactants are available under the PLURONIC (ex. BASF) or Emulgen (ex. Kao.) A further group of such useful nonionic surfactants containing the characteristic alkylene oxide blocks are those can be represented by the formula (B):

$$R\text{-}(EO,PO)_a(EO,PO)_b\text{-}H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block. Specific nonionic surfactants which in general are encompassed by Formula B include butoxy derivatives of propylene oxide/ethylene oxide block polymers having molecular weights within the range of about 2000-5000.

Still further examples of useful nonionic surfactants include those which can be represented by formula (C) as follows:

$$RO\text{-}(BO)_n(EO)_x\text{-}H \quad (C)$$

wherein EO represents ethylene oxide,

BO represents butylene oxide,

R is an alkyl group containing I to 20 carbon atoms, n is about 5-15 and x is about 5-15.

Yet further useful nonionic surfactants include those which may be represented by the following formula (D):

$$HO\text{-}(EO)_x(BO)_n(EO)_y\text{-}H \quad (D)$$

wherein EO represents ethylene oxide,

BO represents butylene oxide, n is about 5-15, preferably about 15, x is about 5-15, preferably about 15, and y is about 5-15, preferably about 15.

Still further exemplary useful nonionic block copolymer surfactants include ethoxylated derivatives of propoxylated ethylene diamine, which may be represented by the following formula:

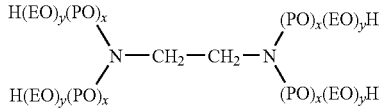

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Further useful non-ionic surfactants which may be used in the inventive compositions include those presently marketed under the trade name Pluronics® (ex. BASF). The compounds are formed by condensing ethylene oxide with a hydrophobic base formed by the condensation of propylene oxide with propylene glycol. The molecular weight of the hydrophobic portion of the molecule is of the order of 950 to 4,000 and preferably 200 to 2,500. The addition of polyoxyethylene radicals of the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants are in liquid form and particularly satisfactory surfactants are available as those marketed as Pluronics® L62 and Pluronics® L64.

Alkylmonoglyocosides and alkylpolyglycosides which find use in the present inventive compositions include known nonionic surfactants which are alkaline and electrolyte stable. Alkylmonoglycosides and alkylpolyglycosides are prepared generally by reacting a monosaccharide, or a compound hydrolyzable to a monosaccharide with an alcohol such as a fatty alcohol in an acid medium. Various glycoside and polyglycoside compounds including alkoxylated glycosides and processes for malting them are disclosed in U.S. Pat. Nos. 2,974,134; 3,219,656; 3,598,865; 3,640,998; 3,707,535, 3,772,269; 3,839,318; 3,974,138; 4,223,129 and 4,528,106 the contents of which are incorporated by reference.

One exemplary group of such useful alkylpolyglycosides include those according to the formula:

$$R_2O—(C_nH_{2n}O)_r-(Z)_x$$

wherein:

$R_2$ is a hydrophobic group selected from alkyl groups, alkylphenyl groups, hydroxyalkylphenyl groups as well as mixtures thereof, wherein the alkyl groups may be straight chained or branched, and which contain from about 8 to about 18 carbon atoms, n has a value of 2-8, especially a value of 2 or 3;

r is an integer from 0 to 10, but is preferably 0,

Z is derived from glucose; and, x is a value from about 1 to 8, preferably from about 1.5 to 5. Preferably the alkylpolyglycosides are nonionic fatty alkylpolyglucosides which contain a straight chain or branched chain $C_8$-$C_{15}$ alkyl group, and have an average of from about 1 to 5 glucose units per fatty alkylpolyglucoside molecule. More preferably, the nonionic fatty alkylpolyglucosides which contain straight chain or branched $C_8$-$C_{15}$ alkyl group, and have an average of from about 1 to about 2 glucose units per fatty alkylpolyglucoside molecule.

A further exemplary group of allyl glycoside surfactants suitable for use in the practice of this invention may be presented by the following formula (A):

$$RO-(R_1O)_y-(G)_x-Z_b \quad (A)$$

wherein:

R is a monovalent organic radical containing from about 6 to about 30, preferably from about 8 to 18 carbon atoms, $R_1$ is a divalent hydrocarbon radical containing from about 2 to about 4 carbon atoms, y is a number which has an average value from about 0 to about 1 and is preferably 0, G is a moiety derived from a reducing saccharide containing 5 or 6 carbon atoms; and, x is a number having an average value from about 1 to 5 (preferably from 1.1 to 2);

Z is $O_2M^1$,

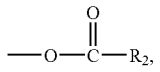

$O(CH_2)$, $CO_2M^1$, $OSO_3M^1$, or $O(CH_2)SO_3M^1$;

$R_2$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, $—CH_2OH$, is oxidized to form a

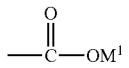

group)

b is a number of from 0 to 3x+1 preferably an average of from 0.5 to 2 per glycosal group;

p is 1 to 10, $M^1$ is $H^+$ or an organic or inorganic counterion, particularly cations such as, for example, an alkali metal cation, ammonium cation, monoethanolamine cation or calcium cation. As defined in Formula (A) above, R is generally the residue of a fatty alcohol having from about 8 to 30 and preferably 8 to 18 carbon atoms. Examples of such alkylglycosides as described above include, for example APG 325 CS Glycoside® which is described as being a 50% $C_9$-$C_{11}$ alkyl polyglycoside, also commonly referred to as D-glucopyranoside, (commercially available from Henkel KGaA) and Glucopon® 625 CS which is described as being a 50% $C_{10}$-$C_{16}$ alkyl polyglycoside, also commonly referred to as a D-glucopyranoside, (ex. Henkel).

Still further useful nonionic surfactants include those based on tallowamine, such as PEG-2 tallowamines.

Further nonionic surfactants which may be included in the inventive compositions include alkoxylated alkanolamides, preferably C8-C24 alkyl di(C2-C3 alkanol amides), as represented by the following formula:

$$R_5—CO—NH—R_6—OH$$

wherein $R_5$ is a branched or straight chain $C_8$-$C_{24}$ alkyl radical, preferably a $C_{10}$-$C_{16}$ alkyl radical and more preferably a $C_{12}$-$C_{14}$ alkyl radical, and $R_6$ is a $C_1$-$C_4$ alkyl radical, preferably an ethyl radical.

The inventive compositions may also include a nonionic amine oxide constituent. Exemplary amine oxides include:

(A) Alkyl di(lower alkyl)amine oxides in which the alkyl group has about 10-20, and preferably 12-16 carbon atoms, and can be straight or branched chain, saturated or unsaturated. The lower alkyl groups include between 1 and 7 carbon atoms. Examples include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide;

(B) Alkyl di(hydroxy lower alkyl)amine oxides in which the alkyl group has about 10-20, and preferably 12-16 carbon atoms, and can be straight or branched chain, saturated or unsaturated. Examples are bis(2-hydroxyethyl)cocoamine oxide, bis(2-hydroxyethyl)tallowamine oxide; and bis(2-hydroxyethyl)stearylamine oxide;

(C) Alkylamidopropyl di(lower alkyl)amine oxides in which the alkyl group has about 10-20, and preferably 12-16 carbon atoms, and can be straight or branched chain, saturated or unsaturated. Examples are cocoamidopropyl dimethyl amine oxide and tallowamidopropyl dimethyl amine oxide; and (D) Alkylmorpholine oxides in which the alkyl group has about 10-20, and preferably 12-16 carbon atoms, and can be straight or branched chain, saturated or unsaturated.

Preferably the amine oxide constituent is an alkyl di(lower alkyl)amine oxide as denoted above and which may be represented by the following structure:

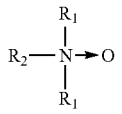

wherein each:

$R_1$ is a straight chained $C_1$-$C_4$ allyl group, preferably both $R_1$ are methyl groups; and, $R_2$ is a straight chained $C_8$-$C_{18}$ alkyl group, preferably is $C_{10}$-$C_{14}$ alkyl group, most preferably is a $C_{12}$ alkyl group.

Each of the alkyl groups may be linear or branched, but most preferably are linear. Most preferably the amine oxide constituent is lauryl dimethyl amine oxide. Technical grade mixtures of two or more amine oxides may be used, wherein amine oxides of varying chains of the $R_2$ group are present. Preferably, the amine oxides used in the present invention include $R_2$ groups which comprise at least 50% wt., preferably at least 60% wt. of $C_{12}$ alkyl groups and at least 25% wt. of $C_{14}$ alkyl groups, with not more than 15% wt. of $C_{16}$, $C_{18}$ or higher alkyl groups as the $R_2$ group.

Of course the nonionic surfactant constituent, when present, my comprise two or more nonionic surfactants. In certain preferred embodiments the inventive compositions comprise at least one nonionic surfactant. When present, any nonionic surfactants present in the compositions of the present invention are desirably included in an amount of from about 0.01% wt. to about 20% wt., more preferably is present in an amount of from about 0.1-20% wt., and most preferably is present in an amount of from about 1 to about 10% wt.

The compositions according to the invention may optionally further comprise an alkyl ethoxylated carboxylate surfactant. In particular, the alkyl ethoxylated carboxylate comprises compounds and mixtures of compounds which may be represented by the formula:

$$R_1(OC_2H_4)_n—OCH_2COO^-M^+$$

wherein $R_1$ is a $C_4$-$C_{18}$ alkyl, n is from about 3 to about 20, and M is hydrogen, a solubilizing metal, preferably an alkali metal such as sodium or potassium, or ammonium or lower alkanolammonium, such as triethanolammonium, monoethanolammonium, or diisopropanolammonium. The lower alkanol of such alkanolammonium will normally be of 2 to 4 carbon atoms and is preferably ethanol. Preferably, R1 is a $C_{12}$-$C_{15}$ alkyl, n is from about 7 to about 13, and M is an alkali metal counterion.

Examples of alkyl ethoxylated carboxylates contemplated to be useful in the present invention include, but are not necessarily limited to, sodium buteth-3 carboxylate, sodium hexeth-4 carboxylate, sodium laureth-5 carboxylate, sodium laureth-6 carboxylate, sodium laureth-8 carboxylate, sodium laureth-11 carboxylate, sodium laureth-13 carboxylate, sodium trideceth-3 carboxylate, sodium trideceth-6 carboxylate, sodium trideceth-7 carboxylate, sodium trideceth-19 carboxylate, sodium capryleth-4 carboxylate, sodium capryleth-6 carboxylate, sodium capryleth-9 carboxylate, sodium capryleth-13 carboxylate, sodium ceteth-13 carboxylate, sodium $C_{12-15}$ pareth-6 carboxylate, sodium $C_{12-15}$ pareth-7 carboxylate, sodium $C_{14-15}$ pareth-8 carboxylate, isostearetb-6 carboxylate as well as the acid form. Sodium-laureth-8 carboxylate, sodium laureth-13 carboxylate, pareth-25-7 carboxylic acid are preferred. A particularly preferred sodium laureth-13 carboxylate can be obtained from Clariant Corp. under the trade name Sandopan® LS-24.

When present, any alkyl ethoxylated carboxylate surfactant present in the compositions of the present invention are desirably included in an amount of from about 0.1 to about 20% by weight, more preferably is present in an amount of from about 0.1-20% wt., and most preferably is present in an amount of from about 1 to about 10% wt. By way of non-limiting example exemplary amphoteric surfactants include one or more water-soluble betaine surfactants which may be represented by the general formula:

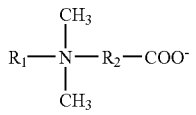

wherein $R_1$ is an alkyl group containing from 8 to 18 carbon atoms, or the amido radical which may be represented by the following general formula:

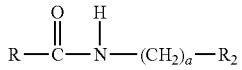

wherein R is an alkyl group having from 8 to 18 carbon atoms, a is an integer having a value of from 1 to 4 inclusive, and $R_2$ is a $C_1$-$C_4$ alkylene group. Examples of such water-soluble betaine surfactants include dodecyl dimethyl betaine, as well as cocoamidopropylbetaine.

The inventive compositions may comprise a detersive surfactant based on a cationic surfactant compound. Certain of these cationic surfactant compounds may also provide a disinfecting or sanitizing benefit to the compositions of which they form a part. Other cationic surfactant compounds may provide a thickening benefit to the compositions of which they form a part.

Exemplary cationic surfactant compounds which may also provide a disinfecting or sanitizing benefit to the compositions include cationic surfactant compositions which provide a germicidal effect to the compositions, and especially preferred are quaternary ammonium compounds and salts thereof, which may be characterized by the general structural formula:

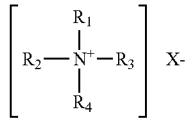

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful in the practice of the present invention include those which have the structural formula:

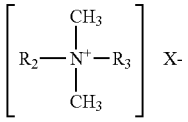

wherein $R_2$ and $R_3$ are the same or different $C_8$-$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or is a methosulfate anion. The alkyl groups recited in $R_2$ and $R_3$ may be straight-chained or branched, but are preferably substantially linear.

Particularly useful quaternary germicides include compositions which include a single quaternary compound, as well as mixtures of two or more different quaternary compounds. Such useful quaternary compounds are available under the BARDAC®, BARQUAT®, HYAMINE®, LONZABAC®, and ONYXIDE® trademarks.

Cationic surfactant compounds which may be used in the compositions of the invention and which may provide a thickening benefit to the compositions include alkoxylated fatty amine compounds. Such alkoxylated fatty amine compounds include primary, secondary and tertiary fatty amines. Exemplary primary fatty amine compounds include for example, those which may be represented by the following structural representation:

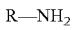

wherein:

R is based on a technical grade mixture of predominantly $C_{10}$-$C_{20}$ straight chained or branched alkyl groups, but preferably are predominantly $C_{16}$-$C_{18}$ straight chained or branched alkyl groups, which groups may be saturated or unsaturated.

Exemplary primary fatty amine compounds include for example, those which may be represented by the following structural representation:

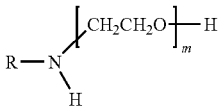

wherein:

R is based on a technical grade mixture of predominantly $C_{10}$-$C_{20}$ straight chained or branched alkyl groups, but preferably are predominantly $C_{16}$-$C_{18}$ straight chained or branched alkyl groups, which groups may be saturated or unsaturated; and, m has a value of from about 2 to about 10, inclusive.

Exemplary alkoxylated fatty tertiary amines include those which may be represented by the following structural representation:

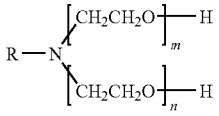

wherein

R is based on a technical grade mixture of predominantly C10-C20 straight chained or branched alkyl groups, but preferably are predominantly C16-C18 straight chained or branched alkyl groups, which groups may be saturated or unsaturated; and wherein m+n=2-10, but preferably m+n=4-6.

It is to be understood that other alkoxylated fatty amines which are not represented by any of the structures indicated above may also be used in the inventive compositions, and that these structures provide examples by way of illustration but not by way of limitation. These materials are available from a variety of sources and include for example alkoxylated amines presently commercially available in the DeThox® Amine series (DeForest Enterprises, Inc.) including DeThox® Amine C-5 and DeThox® Amine C-15, both which are described to be cocoamine ethoxylates, in the Hetoxamine® series (Heterine Inc.) including Hetoxamine® T-5 described to be a PEG-5 tallowamine, Hetoxamine® T-15 described to be a POE-15 tallowamine, and Hetoxamine® described to be a POE-20 tallowamine, as well as in the Rhodameen® series (Rhone-Poulenc) but further useful alkoxylated amines may also be obtained from other commercial sources. One such further class of alkoxylated amines are PEG-tallowamines which include various grades of polyethylene glycol (PEG) polymer which are commercially available under the Aminogen® tradename. Particularly useful and most preferred are the fatty amine compounds disclosed below. These alkoxylated fatty amine surfactants may be used singly, or in combination with one another to form mixtures.

At least one detersive surfactant is necessarily present in the inventive compositions, generally in an amount of at least 0.01% wt., and preferably the total amount of detersive surfactants present in the inventive compositions does not exceed about 20% wt., more preferably does not exceed about 15% wt. Still more preferably the total amount of detersive surfactants present is from 0.05 to 7.5% wt., more preferably from 0.75 to 5% wt.

In addition to at least one detersive surfactant, the thickened acidic liquid cleaning compositions necessarily comprise at least one nonionic surfactant, a narrow range ethoxylated alcohol having two cloud points. Desirably this surfactant is a "narrow range distribution" $C_9$-$C_{11}$ nonionic surfactant with approx. 5.5 mols ethoxylation and with an HLB value of about 12-12.4, and further when dispersed or dissolved at a 1% concentration in water exhibits two cloud points, one at 24-29° C. and a second at 55-58° C. Such a nonionic surfactant is presently commercially available as Berol® 266 (ex. Akzo-Nobel). The inventors have surprisingly discovered that the inclusion of even a small but effective amount of this nonionic surfactant provides improved surface coverage when the compositions are applied from a container, especially from a squeeze bottle onto a vertical or inclined hard surface, as compared to like compositions which omit this constituent but which are applied in an identical manner. Whereas it is admitted that alcohol ethoxylates are generally well known as a class, it was surprisingly discovered by the inventors that the inclusion of the Berol® 266 surfactant functioned as a "superwetter" in that it improved the spreading of the lamina of the composition as it was applied to the interior curved surface of toilet bowls, such that the formation of discrete downwardly extending regions of the said cleaning composition, "fingers", having zones or regions between adjacent fingers of the interior surface of the toilet bowl was substantially reduced. Such was particularly surprising as it was observed that while the formation of such fingers was minimized it was also observed that the rate of vertical descent of the cleaning composition was not undesirably accelerated, as compared to like compositions wherein the Berol® 266 surfactant was omitted. This characteristic provides an important technical benefit in that improved coverage without reapplication of a further quantity of the composition, or without requiring user intervention to help spread the applied composition more evenly is provided. Concurrently, as the inclusion of the said Berol® 266 surfactant appeared to aid in the transverse spreading or distribution of the composition as the lamina of the cleaning composition applied to the sidewall of a toilet bowl descended towards the bottom of the interior of the toilet bowl, the lamina rarely separated into a plurality of discrete downwardly extending regions, viz., fingers of the cleaning composition leaving uncoated regions or zones intermediate such fingers. Thus, the use of the Berol® 266 surfactant appears to provide the dual benefits of (a) improved, and in preferred embodiments almost or complete coverage of the interior sidewall of a toilet bowl by a falling lamina of the cleaning composition with the minimal formation of fingers of the cleaning composition, and (b) no deleterious loss of viscosity of the cleaning composition due to the inclusion of the Berol® 266 surfactant.

While the mechanism of the operation of the Berol® 1266 surfactant and its effect on the fluid flow behavior of the thickened acidic hard surface cleaning compositions of the invention is not fully understood, the results observed were surprising and were not predictable. It was surprising to say the least that this narrow range ethoxylated alcohol surfactant would provide such an effect as other ethoxylated alcohol surfactants did not provide such an effect. Such a superwetter property, which was normally expected of fluorosurfactants could be provided by the narrow range ethoxylated alcohol surfactant, which is more environmentally friendly than fluorosurfactants. While not wishing to be bound by the following hypothesis, it is believed by the present inventors that the addition of the Berol® 266 surfactant may have provided an unexpectedly high decrease in the surface tension of the compositions, while at the same causing little decrease in the viscosity of the compositions. Such may be responsible for the improved surface coverage of the compositions when applied onto vertical or inclined surfaces.

While the nonionic surfactant, a narrow range ethoxylated alcohol having two cloud points may be included in any amount which is found to improve the downward flow characteristics of a lamina of the composition and to minimize the formation of fingers of the composition on a vertical or inclined surface, advantageously this constituent is present in an amount of between about 0.0001-5% wt., preferably 0.01-3.5% wt. based on the total weight of the composition of which it forms a part. Alternately but also preferably the said nonionic surfactant having two cloud points is desirably present in a respective weight ratio of said nonionic surfactant to the sum of all other surfactants present in the liquid compositions of about 1:3 or less, preferably 1:4 or less, yet more preferably 1:5 or less, yet more preferably 1:7 or less, still more preferably 1:8 or less.

The compositions of the invention necessarily include a thickening constituent or constituents which form a thickener system. Thickeners useful in the present invention to achieve this viscosity are selected from the group consisting of polysaccharide polymers selected from cellulose, alkyl celluloses, alkoxy celluloses, hydroxy alkyl celluloses, alkyl hydroxy alkyl celluloses, carboxy alkyl celluloses, carboxy alkyl hydroxy allyl celluloses, naturally occurring polysaccharide polymers such as xanthan gum, guar gum, locust bean gum, tragacanth gum, or derivatives thereof, polycarboxylate polymers, polyacrylamides, clays, and mixtures thereof.

Examples of the cellulose derivatives include methyl cellulose ethyl cellulose, hydroxymethyl cellulose hydroxy ethyl cellulose, hydroxy propyl cellulose, carboxy methyl cellulose, carboxy methyl hydroxyethyl cellulose, hydroxypropyl cellulose, hydroxy propyl methyl cellulose, ethylhydroxymethyl cellulose and ethyl hydroxy ethyl cellulose.

Exemplary polycarboxylate polymers thickeners have a molecular weight from about 500,000 to about 4,000,000, preferably from about 1,000,000 to about 4,000,000, with, preferably, from about 0.5% to about 4% crosslinking. Preferred polycarboxylate polymers include polyacrylate polymers including those sold under trade names Carbopol®, Acrysol® ICS-1 and Sokalan®. The preferred polymers are polyacrylates. Other monomers besides acrylic acid can be used to form these polymers including such monomers as ethylene and propylene which act as diluents, and maleic anhydride which acts as a source of additional carboxylic groups.

The polycarboxylate polymer can be a non-associative thickener or stabilizer, such as a homopolymer or a copolymer of an olefinically unsaturated carboxylic acid or anhydride monomers containing at least one activated carbon to carbon olefinic double bond and at least one carboxyl group or an alkali soluble acrylic emulsion, or an associative thickener or stabilizer, such as a hydrophobically modified alkali soluble acrylic emulsion or a hydrophobically modified nonionic polyol polymer, i.e., a hydrophobically modified urethane polymer, or combinations thereof. The copolymers are preferably of a polycarboxylic acid monomer and a hydrophobic monomer. The preferred carboxylic acid is acrylic acid. The homopolymers and copolymers preferably are crosslinked.

Homopolymers of polyacrylic acid are homopolymers of unsaturated, polymerizable carboxylic monomers such as acrylic acid, methacrylic acid, maleic acid, itaconic acid, maleic anhydride, and the like.

Hydrophobically modified polyacrylic acid polymers are polymers have a large hydrophilic portion (the polyacrylic acid portion) and a smaller hydrophobic portion (which can be derived from a long carbon chain acrylate ester). Representative higher alkyl acrylic esters are decycl acrylate, lauryl acrylate, stearyl acrylate, behenyl acrylate and melissyl acrylate, and the corresponding methacrylates. It should be understood that more than one carboxylic monomer and more than one acrylate ester or vinyl ester or ether or styrenic can be used in the monomer charge. The polymers can be dispersed in water and neutralized with base to thicken the aqueous composition, form a gel, or emulsify or suspend a deliverable. Exemlarly hydrophobically modified polyacrylic polymers are sold as Carbopol® 1342 and 1382 and Pemulen® TR-1, TR-2, 1621, and 1622. The carboxyl containing polymers are prepared from monomers containing at least one activated vinyl group and a carboxyl group, and would include copolymers of polymerizable carboxylic monomers with acrylate esters, acrylamides, alkylated acrylamides, olefins, vinyl esters, vinyl ethers, or styrenics. The carboxyl containing polymers have molecular weights greater than about 500 to as high as several billion, or more, usually greater than about 10,000 to 900,000 or more.

Also useful are interpolymers of hydrophobically modified monomers and steric stabilizing polymeric surface active agents having at least one hydrophilic moiety and at least one hydrophobic moiety or a linear block or random comb configuration or mixtures thereof. Examples of steric stabilizers which can be used are Hypermer®, which is a poly(12-hydroxystearic acid) polymer, (ex. ICI) and Pecosil®, which is a methyl-3-polyethoxypropyl siloxane-ω-phosphate polymer, (ex. Phoenix Chemical, Somerville, N.J.)

The polymers can be crosslinked in a manner known in the art by including, in the monomer charge, a suitable crosslinker in amount of about 0.1 to 4%, preferably 0.2 to 1% by weight based on the combined weight of the carboxylic monomer and the comonomer(s). The crosslinker is selected from polymerizable monomers which contain a polymerizable vinyl group and at least one other polymerizable group. Polymerization of the carboxyl-containing monomers is usually carried out in a catalyzed, free radical polymerization process, usually in inert diluents, as is known in the art.

Other polycarboxylic acid polymer compositions which can be employed include, for example, crosslinked copolymers of acrylates, (meth)acrylic acid, maleic anhydride, and various combinations thereof. Commercial polymers are available from Rheox Inc., Highstown, N.J. (such as Rheolate® 5000 polymer), 3 V Sigma, Bergamo, Italy (such as Stabelyn® 30 polymer, which is an acrylic acid/vinyl ester copolymer, or Polygel® and Synthalen® polymers, which are crosslinked acrylic acid polymers and copolymers), Noveon (such as Carbopol 674 (lightly crosslinked polyacrylate polymer), Carbopol 676 (highly crosslinked polyacrylate polymer), Carbopol EP-1 thickener, which is a acrylic emulsion thickener), or Rohm and Haas (such as Acrysol® ICS-1 and Aculyn® 22 thickeners, which are hydrophobically modified alkali-soluble acrylic polymer emulsions and Aculyn® 44 thickener, which is a hydrophobically modified nonionic polyol). Preferred are the Carbopol® and Pemulen® polymers, generally. The choice of the specific polymer to be employed will depend upon the desired rheology of the composition, and the identity of other compositional ingredients.

Clay thickeners comprise, for example, colloid-forming clays, for example, such as smectite and/or attapulgite types. The clay materials can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonite) and attapulgites (or polygorskites).

Smectites are three-layered clays. There are two distinct classes of smectite-type clays. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)(OH)_2$, for the aluminum and magnesium oxide type clays, respectively. It is to be recognized that the range of the water of hydration in the above formulas may vary with the processing to which the clay has been subjected.

Commercially available clays include, for example, montmorillonite, bentonite, volchonskoite, nontronite, beidellite, hectorite, saponite, sauconite and vermiculite. The clays herein are available under various trade names such as Gelwhite GP, Gelwhite H, Mineral Colloid BP, and Laponite from Southern Clay Products, Inc., Texas; and Van Gel O from R. T. Vanderbilt. Gelwhite H-NF has a typical chemical analysis of $SiO_2$ 66.5%; $Al_2O_3$ 14.7%; MgO 3.2%; $Fe_2O_3$ 0.8%; CaO 2.2%; $Na_2O$ 3.3%; $K_2O$ 0.1%; $TiO_2$ 0.2%. Gelwhite L-NF has a typical chemical analysis of $SiO_2$ 66.5%; $Al_2O_3$ 14.7%; MgO 3.2%; $Fe_2O_3$ 0.8%; CaO 2.2%; $Na_2O$ 3.3%; $K_2O$ 0.1%; $TiO_2$ 0.2%. Gelwhite GP has a typical chemical analysis of $SiO_2$ 66.5%; $Al_2O_3$ 14.7%; MgO 3.2%; $Fe_2O_3$ 0.8%; CaO 2.2%; $Na_2O$ 3.3%; $K_2O$ 0.1%; $TiO_2$ 0.2%. Mineral Colloid BP has a typical chemical analysis of $SiO_2$ 62.9%; $Al_2O3$ 17.1%; MgO 2.4%; $Fe_2O_3$ 4.8%; CaO 0.7%; $Na_2O$ 2.1%; $K_2O$ 0.2%; $TiO_2$ 0.1%.

A second type of expandable clay material useful in the instant invention is classified geologically as attapulgite (polygorskite). Attapulgites are magnesium-rich clays having principles of superposition of tetrahedral and octahedral unit cell elements different from the smectites. A typical attapulgite analyses yields 55.02% $SiO_2$; 10.24% $Al_2O_3$; 3.53% $Fe_2O_3$; 10.45% MgO; 0.47% $K_2O$; 9.73% $H_2O$ removed at 150° C.; 10.13% $H_2O$ removed at higher temperatures. Like the smectites, aftapulgite clays are commercially available. The preferred clay thickeners comprise the inorganic, colloid forming clays of smectite and/or attapulgite types.

The thickener constituent may be present in amount which is found to be effective in increasing the viscosity of the compositions of the invention to a desired viscosity, preferably a viscosity of between about 0 and about 15,000 cPs, preferably a viscosity of from about 50 to about 1200 cPs, and especially from about 80 to about 500 cPs. The viscosity of the compositions may be measured according to known techniques, for example using a Brookfield Type III viscometer, #2 spindle, 20 rpm at room temperature (20° C.). While it is clearly understood that the amount of a particular thickener constituent needed to produce a desired viscosity may vary depending upon the nature of the particular thickener constituent and the other constituents present in the composition, advantageously the thickener constituent is present in an amount of from 0.01-5% wt.

It is to be specifically noted that one or more surfactants may be used as a thickener constituent and/or the thickener system. When such are utilized, such surfactants may thus simultaneously provide both the detersive surfactant and the thickener system and in such an instance a separate detersive surfactant is not required to be present. Exemplary surfactants which may provides both cleaning and thickening include amine oxides, sarcosinates as well as alkoxylated fatty amine compounds.

As is noted above, the compositions according to the invention are largely aqueous in nature. Water is added to the foregoing constituents in order to provide 100% by weight of the composition. Desirably water provides at least 60% wt., and in order of increasing preference comprises at least: 70% wt. 75% wt., 80% wt., 82% wt., 84% wt., 86% wt., 88% wt., 90% wt., 91% wt., 92% wt., 93% wt., 94% wt., 95% wt., 96% wt., and 97% wt. of water based on the total weight of the liquid compositions of the invention of which they form a part. The water may be tap water, but is preferably distilled or 'soft' water but most preferably deionized water. If the water is tap water, it is preferably substantially free of any undesirable impurities such as organics or inorganics, especially mineral salts which are present in hard water.

The compositions of the invention may also include one or more further optional constituents such as known art additives which may be included in order to provide a technical or esthetic benefit to the compositions. By way of non-limiting example, said constituents may include: organic solvents, bleach or oxidizing agents, coloring agents, including dyes and pigment compositions, fragrances (whether natural or synthetically produced), fragrance adjuvants and/or fragrance solubilizers, pH-adjusting agents, pH buffers, salts including inorganic or organic salts which may provide electrolytes to the compositions, film forming constituents, preservative compositions, as well as other known art additives not particularly elucidated here. Such constituents as described above include known art compositions, including those described in McCutcheon's Detergents and Emulsifiers, North American Edition, 1998; Kirk-Othmer Encyclopedia of Chemical Technology, 4th Ed., Vol. 23, pp. 478-541, the contents of which are herein incorporated by reference.

Exemplary organic solvents which may be included in the inventive compositions include those which are at least partially water-miscible such as alcohols, water-miscible ethers (e.g. diethylene glycol diethylether, diethylene glycol dimethylether, propylent glycol dimethylether), water-miscible glycol ether (e.g. propylene glycol monomethylether, propylene glycol mono ethylether, propylene glycol monopropylether, propylene glycol monobutylether, ethylene glycol monobutylether, dipropylene glycol monomethylether, dipropylene glycol monopropyl ether, dipropylene glycol monobutyl ether, diethyleneglycol monobutylether), lower esters of monoalkylethers of ethyleneglycol or propylene glycol (e.g. propylene glycol monomethyl ether acetate) all commercially available such as from Union Carbide (Danbury, Conn.), Dow Chemical Co. (Midland, Mich.) or Hoescht (Germany). Further organic solvents volatile solvents suitable for use in the inventive are the hydrocarbon solvents, especially branched chain hydrocarbon solvents. The hydrocarbon solvents may be linear or branched, saturated or unsaturated, hydrocarbons having from about 8 to about 18 carbon atoms, preferably comprise from about 12 to about 16 carbon atoms. Saturated hydrocarbons are preferred, as are branched hydrocarbons. Nonlimiting examples of some suitable linear hydrocarbons include decane, dodecane, decene, tridecene, and combinations thereof. Exemplary branched hydrocarbons include isoparaffins, examples of which include commercially available isoparaffins from ExxonMobil Corp. such as ISOPAR H and ISOPAR K ($C_{11}$-$C_{12}$ isoparaffins), and ISOPAR L ($C_{11}$-$C_{13}$ isoparaffins). Preferred branched hydrocarbons are isohexadecane, isododecane, 2,5-dimethyl decane, isotetradecane, and combinations thereof. Mixtures of several organic solvents can also be used.

Optionally, a bleach constituent or an oxidizing constituent may be present. The bleach constituent include those selected from alkali metal and alkaline earth salts of hypohalite, haloamines, haloimines, haloimides and haloamides. All of these are believed to produce hypohalous bleaching species in situ. Hypochlorite and compounds producing hypochlorite in aqueous solution are preferred, although hypobromite is also suitable. Representative hypochlorite-producing compounds include sodium, potassium, lithium and calcium hypochlorite, chlorinated trisodium phosphate dodecahydrate, potassium and sodium dichloroisocyanurate and trichlorocyanuric acid. Organic bleach sources suitable for use include heterocyclic N-bromo and N-chloro imides such as trichlorocyanuric and tribromocyanuric acid, dibromo- and dichlorocyanuric acid, and potassium and sodium salts thereof, N-brominated and N-chlorinated succinimide, malonimide, phthalimide and naphthalimide. Also suitable are hydantoins, such as dibromo- and dichloro dimethylhydantoin, chlorobromodimethyl hydantoin, N-chlorosulfamide(haloamide) and chloramine(haloamine). Particularly preferred for use is sodium hypochlorite having the chemical formula NaOCl. The oxidizing constituent is preferably a peroxyhydrate or other agent which releases hydrogen peroxide in aqueous solution. Such materials are per se, known to the art. Such peroxyhydrates are to be understood as to encompass hydrogen peroxide as well as any material or compound which in an aqueous composition yields hydrogen peroxide. Examples of such materials and compounds include without limitation: alkali metal peroxides including sodium peroxide and potassium peroxide, alkali perborate monohydrates, alkali metal perborate tetrahydrates, alkali metal persulfate, alkali metal percarbonates, alkali metal peroxyhydrate, alkali metal peroxydihydrates, and alkali metal carbonates especially where such alkali metals are sodium or potassium. Further useful are various peroxydihydrate, and organic peroxyhydrates such as urea peroxide. Desirably, when present, the oxidizing constituent is hydrogen peroxide.

When an oxidizing agent is present, especially where such is hydrogen peroxide, it may be advantageous to include a peroxide stabilizer which may be useful in improving the high temperature stability of the peroxide constituent, and of the compositions as well. Such a peroxide stabilizer may be one or more known art peroxide stabilizers including, inter alia, one or more organic phosphonates, stannates, pyrophosphates. Further known art peroxide stabilizers include 1-hydroxy-1,1-ethylidene diphosphonate commercially available as Dequest® 2010 as well as further similar phosphonate compounds.

The compositions of the invention optionally but in certain cases desirably include a fragrance constituent. Such fragrances which may be natural or synthetically produced. Fragrance raw materials may be divided into three main groups: (1) the essential oils and products isolated from these oils; (2) products of animal origin; and (3) synthetic chemicals. Generally perfumes are complex mixtures or blends various organic compounds including, but not limited to, certain alcohols, aldehydes, ethers, aromatic compounds and varying amounts of essential oils such as from about 0 to about 85% by weight, usually from about 10 to about 70% by weight, the essential oils themselves being volatile odiferous compounds and also functioning to aid in the dissolution of the other components of the fragrance composition. Examples of such fragrances include digeranyl succinate, dineryl succinate, geranyl neryl succinate, geranyl phenylacetate, neryl phenylacetate, geranyl laurate, neryl laurate, di(b-citronellyl)maleate, dinonadol maleate, diphenoxyanol maleate, di(3,7-dimethyl-1-octanyl)succinate, di(cyclohexylethyl)maleate, diflralyl succinate, di(phenylethyl)adipate, 7-acetyl-1,2,3,4,5,6,7,8-octahydro-1,1,6,7-tetramethyl naphthalene, ionone methyl, ionone gamma methyl, methyl cedrylone, methyl dihydrojasmonate, methyl 1,6,10-trimethyl-2,5,9-cyclododecatrien-1-yl ketone, 7-acetyl-1,1,3,4,4,6-hexamethyl tetralin, 4-acetyl-6-tertbutyl-1-, 1-dimethyl indane, para-hydroxy-phenyl-butanone, benzophenone, methyl beta-naphthyl ketone, 6-acetyl-1,1,2,3,3,5hexamethyl indane, 5-acetyl-3-isopropyl-1,1,2,6-tetramethyl indane, 1-dodecanal, 4-(4-hydroxy-4-methylpentyl)-3-cyclohexene-1-carboxaldehyde, 7-hydroxy-3,7-dimethyl ocatanal, 10-undecen-1-al, isohexenyl cyclohexyl carboxaldehyde, formyl tricyclodecane, condensation products of hydroxycitronellal and methyl anthranilate, condensation products of hydroxycitronellal and indol, condensation products of phenyl acetaldehyde and indol, 2-methyl-3-(para-tert-butylphenyl)-propionaldehyde, ethyl vanillin, heliotropin, hexyl cinnamic aldehyde, amyl cinnamic aldehyde, 2-methyl-2-(para-iso-propylphenyl)propionaldehyde, coumarin, decalactone gamma, cyclopentadecanolide, 16-hydroxy-9-hexadecenoic acid lactone, 1,3,4,6,7,8-hexahydro-4,6,6,7,8,8-hexamethylcyclopenta-gamma-2-b-enzopyrane, beta-naphthol methyl ether, ambroxane, dodecahydro-3a,6,6,9a-t-etramethylnaphtho[2,1b]furan, cedrol, 5-(2,2,3-trimethylcyclopent-3-enyl)-3-methylpentan-2-ol, 2-ethyl-4-(2,2,3-trimethyl-3-cyclopenten-1-yl)-2-bute-n-1-ol, caryophyllene alcohol, tricyclodecenyl propionate, tricyclodecenyl acetate, benzyl salicylate, cedryl acetate, para-(tert-butyl)cyclohexyl acetate, essential oils, resinoids, and resins from a variety of sources including but not limited to orange oil, lemon oil, patchouli, Peru balsam, Olibanum resinoid, styrax, labdanum resin, nutmeg, cassia oil, benzoin resin, coriander, lavandin, and lavender, phenyl ethyl alcohol, terpineol, linalool, linalyl acetate, geraniol, nerol, 2-(1,1-dimethylethyl)cyclohexanol acetate, benzyl acetate, orange terpenes, eugenol, diethylphthalate, and combinations thereof. In the present invention, the precise composition of the fragrance is of no particular consequence so long as it may be effectively included as a constituent of the compositions, and have a pleasing fragrance. Two preferred fragrances include terpene alcohols which are effective to provide a pine-type scent, or a citrus-type scent depending upon its source and/or composition, as well as methyl salicylate.

Fragrance compositions as received from a supplier may be provided as an aqueous or organically solvated composition, and may include as a hydrotrope or emulsifier a surface-active agent, typically a surfactant, in minor amount, generally not in excess of about 1.5% wt. Such fragrance compositions are quite usually proprietary blends of many different specific fragrance compounds. However, one of ordinary skill in the art, by routine experimentation, may easily determine whether such a proprietary fragrance composition is compatible in the compositions of the present invention.

Such fragrances may be added in any conventional manner, admixing to a composition or blending with other constituents used to form a composition, in amounts which are found to be useful to enhance or impart the desired scent characteristic to the composition, and/or to cleaning compositions formed therefrom.

Further optional, but advantageously included constituents are one or more coloring agents which find use in modifying the appearance of the compositions and enhance their appearance from the perspective of a consumer or other end user. Known coloring agents. e.g., pigments and dyes including CI Direct dyes as well as FD&C approved colorants may be incorporated in the compositions in any effective amount to improve or impart to compositions a desired appearance or color. Such a coloring agent or coloring agents may be added in a conventional fashion, i.e., admixing to a composition or blending with other constituents used to form a composition. The inclusion of a coloring agent is frequently desired in that such provides improved visibility of the composition and its presence on a surface being treated. Typically such one or more coloring agents are present in amounts not in excess of about 1.5% wt. yet more preferably are not present in amounts in excess of 1% wt.

The compositions of the invention may include one or more pH adjusting agents, or compounds which provide a degree of alkalinity to the compositions. Particularly preferred pH adjusting agents include ammonium hydroxide, sodium hydroxide and tetrasodium ethylenediamine tetraacetic acid ($Na_4EDTA$). When included such pH adjusting agents are typically present in amounts not in excess of about 3% wt.

The use of one or more pH buffering compositions so as to maintain the pH of the inventive compositions may also be added. While the compositions of the invention generally does not require a pH buffering composition, the use of such a pH buffering composition may provide the benefit of hard water ion sequestration. Examples of such useful pH buffer compounds and/or pH buffering systems or compositions are alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use as buffers such materials as aluminosilicates (zeolites), borates, aluminates and certain organic materials such as gluconates, succinates, maleates, citrates, and their alkali metal salts. Such buffers keep the pH ranges of the compositions of the present invention within acceptable limits. Others, not particularly elucidated here may also be used.

Exemplary salts which may be included in the compositions include alkali metal and/or alkaline earth metal salts, e.g. those based on borates, bromides, fluorides, phosphates, carbonates, bicarbonates, citrates, chlorides, sulfates, acetates, and lactates. The inclusion of one or more such salts may provide electrolytes which may alter the viscosity of the compositions in which they are present, particularly wherein an acrylate based thickener constituent is used.

The compositions of the invention preferably include a film forming constituent in an effective amount. The use of film forming constituent is believed to provide for a reduction in limescale deposition on the treated hard surfaces, as it is believed that the long term buildup of limescale may be resisted or retarded on hard surfaces, viz., lavatory surfaces and lavatory appliances due to the presence of the film-forming constituent thereon. While it is preferred that the film forming constituent deposit a generally continuous film on a hard surface, it is to be understood that while the film forming constituent need be present in the present inventive compositions it is not required that any layer or film formed therefrom which is formed on the surface of a lavatory appliance, e.g., toilet bowl, be necessarily uniform either in thickness or be a continuous film providing uninterrupted surface coverage although such would be preferred. Rather it is contemplated that film forming materials useful in the present invention need not form a continuous or uniform coating, as it is only required that the film forming materials provide some extent of a surface coating to a hard surface upon which it is applied. It is to be understood that the potential for forming the film layer from a film forming composition is influenced by several factors, inter alia, the nature of the hard surface being treated, the geometry and configuration of the hard surface being treated, the fluid dynamics of the delivery and application of the liquid composition of the invention onto the hard surface, as well as the quality of the water present in the lavatory appliance.

The film-forming polymer may be present in any amount which is found effective in forming a film on a hard surface being treated. It will be understood that this such a minimum amount will vary widely, and is in part dependent upon the molecular weight of the film forming polymer utilized in a formulation, but desirably at least about 0.001% wt. should be present. More preferably the film forming polymer comprises from 0.001% wt. to 10% wt. of the compositions of which it forms a part.

Exemplary materials useful in the film forming constituent include film forming polymers such as:

a polymer having the formula

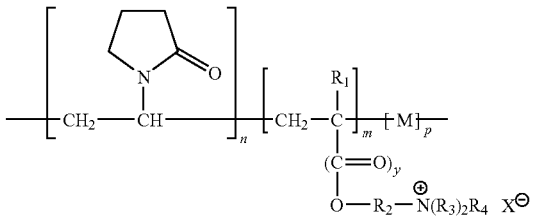

in which n represents from 20 to 99 and preferably from 40 to 90 mol %, m represents from 1 to 80 and preferably from 5 to 40 mol %; p represents 0 to 50 mol, (n+m+p=100); $R_1$ represents H or $CH_3$; y represents 0 or 1; $R_2$ represents —$CH_2$—CHOH—$CH_2$— or $C_xH_{2x}$ in which x is 2 to 18; $R_3$ represents $CH_3$, $C_2H_5$ or t-butyl; $R_4$ represents $CH_3$, $C_2H_5$ or benzyl; X represents Cl, Br, I, ½$SO_4$, $HSO_4$ and $CH_3SO_3$; and M is a vinyl or vinylidene monomer copolymerisable with vinyl pyrrolidone other than the monomer identified in $[\ ]_m$;

water soluble polyethylene oxide;

polyvinylpyrrolidone;

high molecular weight polyethylene glycol;

polyglycoside;

polyvinylcaprolactam;

vinylpyrrolidone/vinyl acetate copolymer;

vinylpyrrolidone/vinyl caprolactam/ammonium derivative terpolymer, especially where the ammonium derivative monomer has 6 to 12 carbon atoms and is selected from diallylamino alkyl methacrylamides, dialkyl dialkenyl ammonium halides, and a dialkylamino alkyl methacrylate or acrylate;

polyvinylalcohol; and cationic cellulose polymer;

one or more of which may be present in effective amounts.

A first film-forming polymer contemplated to be useful in the present compositions is one having the formula

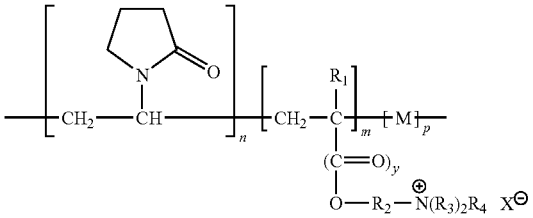

are more fully described in U.S. Pat. No. 4,445,521, U.S. Pat. No. 4,165,367, U.S. Pat. No. 4,223,009, U.S. Pat. No. 3,954,960, as well as GB 1,331,819, the contents of which are hereby incorporated by reference.

The monomer unit within $[\ ]_m$ is, for example, a di-lower alkylamine alkyl acrylate or methacrylate or a vinyl ether derivative. Examples of these monomers include dimethylaminomethyl acrylate, dimethylaminomethyl methacrylate, diethylaminomethyl acrylate, diethylaminomethyl methacrylate, dimethylaminoethyl acrylate, dimethylaminoethyl methacrylate, dimethylaminobutyl acrylate, dimethylaminobutyl methacrylate, dimethylaminoamyl methacrylate, diethylaminoamyl methacrylate, dimethylaminohexyl acrylate, diethylaminohexyl methacrylate, dimethylaminooctyl acrylate, dimethylaminooctyl methacrylate, diethylaminooctyl acrylate, diethylaminooctyl methacrylate, dimethylaminodecyl methacrylate, dimethylaminododecyl methacrylate, diethylaminolauryl acrylate, diethylaminolauryl methacrylate, dimethylaminostearyl acrylate, dimethylaminostearyl methacrylate, diethylaminostearyl acrylate, diethylaminostearyl methacrylate, di-t-butylaminoethyl methacrylate, di-t-butylaminoethyl acrylate, and dimethylamino vinyl ether.

Monomer M, which can be optional (p is up to 50) can comprise any conventional vinyl monomer copolymerizable with N-vinyl pyrrolidone. Thus, for example, suitable conventional vinyl monomers include the alkyl vinyl ethers, e.g., methyl vinyl ether, ethyl vinyl ether, octyl vinyl ether, etc.; acrylic and methacrylic acid and esters thereof, e.g., methacrylate, methyl methacrylate, etc.; vinyl aromatic monomers, e.g., styrene, a-methyl styrene, etc; vinyl acetate; vinyl alcohol; vinylidene chloride; acrylonitrile and substituted derivatives thereof; methacrylonitrile and substituted derivatives thereof; acrylamide and methacrylamide and N-substituted derivatives thereof; vinyl chloride, crotonic acid and esters thereof; etc. Again, it is noted that such optional copolymerizable vinyl monomer can comprise any conventional vinyl monomer copolymerizable with N-vinyl pyrrolidone.

The film-forming polymers of the present invention are generally provided as a technical grade mixture which includes the polymer dispersed in an aqueous or aqueous/alcoholic carrier. Such include materials which are presently commercially available include quaternized copolymers of vinylpyrrolidone and dimethylaminoethyl methacrylate sold as Gafquat® copolymers (ex. ISP Corp., Wayne, N.J.) which are available in a variety of molecular weights.

Further exemplary useful examples of the film-forming polymers of the present invention include quaternized copolymers of vinylpyrrolidone and dimethylaminoethyl methacrylate as described in U.S. Pat. No. 4,080,310, to Ng, the contents of which are herein incorporated by reference. Such quaternized copolymers include those according to the general formula:

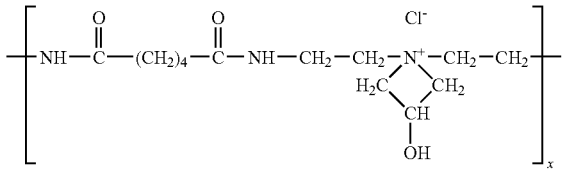

wherein "x" is about 40 to 60. Further exemplary useful copolymers include copolymers of vinylpyrrolidone and dimethylaminoethylmethacrylate quaternized with diethyl sulphate (available as Gafquat® 755 ex., ISP Corp., Wayne, N.J.).

A particularly useful film-forming polymer according to the invention is a quaternized polyvinylpyrrolidone/dimethylamino ethylmethacrylate copolymer which is commercially available as Gafquat® 734, is disclosed by its manufacturer to be:

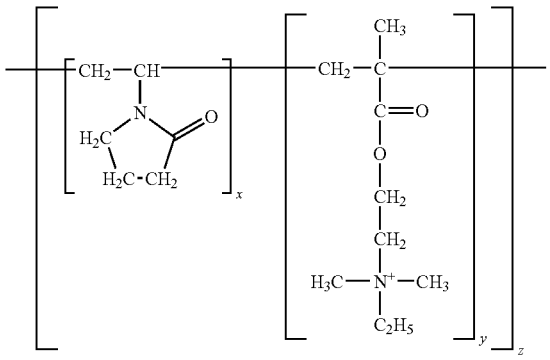

wherein x, y and z are at least 1 and have values selected such that the total molecular weight of the quaternized polyvinylpyrrolidone/dimethylamino ethylmethacrylate copolymer is at least 10,000 more desirably has an average molecular weight of 50,000 and most desirably exhibits an average molecular weight of 100,000. A further useful, but less preferred quaternized polyvinylpyrrolidone/dimethylamino ethylmethacrylate copolymer is available as Gafquat® 755N which is similar to the Gafquat® 734 material describe above but has an average molecular weight of about 1,000,000. These materials are sometimes referred to as "Polyquatemium-11".

Polyethylene oxides for use in the compositions according to the invention may be represented by the following structure:

$$(CH_2CH_2O)_x$$

where:

x has a value of from about 2000 to about 180,000.

Desirably, these polyethylene oxides may be further characterized as water soluble resins, having a molecular weight in the range of from about 100,000 to about 8,000,000. At room temperature (68° F., 20° C.) they are solids. Particularly useful as the film-forming, water soluble polyethylene oxide in the inventive compositions are POLYOX water-soluble resins (ex. Union Carbide Corp., Danbury Conn.).

Further contemplated as useful in the place of, or in combination with these polyethylene oxides are polypropylene oxides, or mixed polyethylene oxides-polypropylene oxides having molecular weights in excess of about 50,000 and if present, desirably having molecular weights in the range of from about 100,000 to about 8,000,000. According to particularly desirable embodiments of the invention, the film-forming constituent of the present invention is solely a water soluble polyethylene oxide.

The polyvinylpyrrolidone polymers useful in the present inventive compositions exhibit a molecular weight of at least about 5,000, with a preferred molecular weight of from about 6,000-3,000,000.

The polyvinylpyrrolidone is generally provided as a technical grade mixture of polyvinylpyrrolidone polymers within approximate molecular weight ranges. Exemplary useful polyvinylpyrrolidone polymers are available in the PVP line materials (ex. ISP Corp.) which include PVP K 15 polyvinylpyrrolidone described as having molecular weight in the range of from 6,000-15,000; PVP-K 30 polyvinylpyrrolidone with a molecular weight in the range of 40,000-80,000; PVP-K 60 polyvinylpyrrolidone with a molecular weight in the range of 240,000-450,000; PVP-K 90 polyvinylpyrrolidone with a molecular weight in the range of 900,000-1,500,000; PVP-K 120 polyvinylpyrrolidone with a molecular weight in the range of 2,000,000-3,000,000. Further preferred examples of polyvinylpyrrolidones are described in the Examples.

Other suppliers of polyvinylpyrrolidone include AllChem Industries Inc, Gainesville, Fla., Kraft Chemical Co., Melrose Park, Ill., Alfa Aesar, a Johnson Matthey Co., Ward Hill, Mass., and Monomer-Polymer & Dajac Labs Inc., Feasterville, Pa.

High molecular weight polyethylene glycol polymers useful in the present inventive compositions exhibit a molecular weight of at least about 100, preferably exhibits a molecular weight in the range of from about 100 to about 10,000 but most preferably a molecular weight in the range of from about 2000 to about 10,000.

Particularly useful high molecular weight polyethylene glycols are available under the tradename CARBOWAX® (ex. Union Carbide Corp.). Other suppliers of high molecular weight polyethylene glycols include Ashland Chemical Co., BASF Corp., Norman, Fox & Co., and Shearwater Polymers, Inc.

Exemplary polyglycosides include alkyl monoglycosides and polyglycosides which are prepared generally by reacting a monosaccharide, or a compound hydrolyzable to a monosaccharide with an alcohol such as a fatty alcohol in an acid medium.

Exemplary glycosides which may be used include alkylpolyglycoside surfactants which may be represented by formula I below:

$$RO(R'O)_x(Z)_y$$

wherein:

R is a monovalent organic radical containing from about 6 to about 30 carbon atoms;

R' is a divalent hydrocarbon radical containing from about 2 to about 4 carbon atoms, especially ethyl and propyl radicals;

Z is a saccharide residue having from 4 to 8, especially about 5-6 carbon atoms;

O is an oxygen atom;

x is a number which has an average value from about 0 to about 12; and, y is a number having an average value from about 1 to about 6.

By way of non-limiting examples useful alkylpolyglycosides include GLUCOPON® 225, described to be an alkylpolyglycoside in which the alkyl group contains 8 to 10 carbon atoms; APG® 325 and APG® 300, each described to be an alkyl polyglycoside in which the alkyl group contains 9 to 11 carbon atoms but having differing average degrees of polymerization; GLUCOPON® 625 and GLUCOPON® 600, each described to be an alkyl polyglycoside in which the alkyl groups contains 12 to 16 carbon atoms but having a different average degrees of polymerization; PLANTAREN® 2000, described to be a $C_{8-16}$alkylpolyglycoside; PLANTAREN® $C_{12-16}$ alkylpolyglycoside; PLANTAREN® 1200, described to be a $C_{12-16}$ alkylpolyglycoside. Each of these materials are presently commercially available from Cognis. Other examples include alkyl polyglycoside surfactant compositions which are comprised of mixtures of compounds of the aforesaid formula wherein Z represents a moiety derived from a reducing saccharide containing 5 or 6 carbon atoms; a is zero; b is a number from 1.8 to 3; and R is an alkyl radical having from 8 to 20 carbon atoms.

The most preferable alkylpolyglycoside compound is according to the structure:

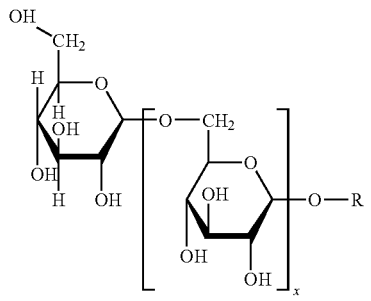

wherein:

R is an alkyl group, preferably a linear alkyl chain, which comprises $C_8$ to $C_{16}$ alkyl groups;

x is an integer value of from 0-3, inclusive.

Examples of such alkylpolyglycoside compounds according to the aforesaid structure include: where R is comprised substantially of $C_8$ and $C_{10}$ alkyl chains yielding an average value of about 9.1 alkyl groups per molecule (GLUCOPON 220 UP, GLUCOPON 225 DK); where R is comprised of $C_8$, $C_{10}$, $C_{12}$, $C_{14}$ and $C_{16}$ alkyl chains yielding an average value of about 10.3 alkyl groups per molecule (GLUCOPON 425N); where R is comprised substantially of $C_{12}$, $C_{14}$ and $C_{16}$ alkyl chains yielding an average value of about 12.8 alkyl groups per molecule (GLUCOPON 600 UP, GLUCOPON 625 CSUP, and GLUCOPON 625 FE, all of which are available from Cognis). Also useful as the alkylpolyglycoside compound is TRITON CG-110 (Union Carbide Corp. subsidiary of Dow Chemical). Further examples of commercially available alkylglycosides as described above include, for example, GLUCOPON 325N which is described as being a 50% $C_9$-$C_{11}$ alkyl polyglycoside, also commonly referred to as D-glucopyranoside (from Cognis). Particularly preferred as the alkylpolyglycoside compounds are those illustrated in the Examples.

Exemplary film-forming polyvinylcaprolactams include polyvinylcaprolactam compounds marketed under the tradename LUVISKOL® (ex. BASF Corp.). Such polyvinylcaprolactams may be represented by the following structural formula:

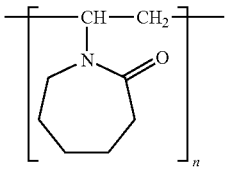

Where n has a value of at least about 800, and preferably a value in the range of from about 500 to about 1000.

Exemplary vinylpyrrolidone/vinylacetate copolymers which find use in the present inventive compositions include those vinylpyrrolidone, vinylacetate copolymers, examples of which are presently commercially available. Such vinylpyrrolidone/vinylacetate copolymers are comprised of vinylpyrrolidone monomers which may be represented by the following structural formula:

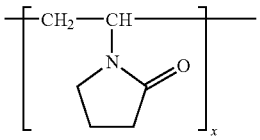

and vinylacetate monomers which may be represented by the following structural formula:

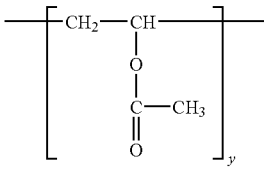

which are usually formed by a free-radical polymerization reaction to produce linear random vinylpyrrolidone/vinylacetate copolymers. The resultant vinylpyrrolidone/vinylacetate copolymers may comprise varying amounts of the individual vinylpyrrolidone monomers and vinylacetate monomers, with ratios of vinylpyrrolidone monomer to vinylacetate monomers from 30/70 to 70/30. The values of x and y in the structural formula should have values such that x+y=100 to 500, preferably x+y=150 to 300. Such values correspond to provide vinylpyrrolidone/vinylacetate copolymers having a total molecular weight in the range from about 10,000 to about 100,000, preferably from about 12,000 to about 60,000. Desirably the ratio of x:y is 0.1:4.0, preferably from 0.2:3.0. Such ratios of x:y provide the preferred vinylpyrrolidone/vinylacetate copolymers which have vinylpyrrolidone monomer to vinylacetate monomers from 0.3/2.5.

Such vinylpyrrolidone/vinylcaprolactam/ammonium derivative terpolymers are comprised of vinylpyrrolidone monomers which may be represented by the following structural formula:

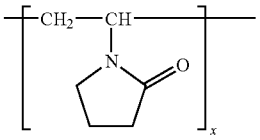

and vinylcaprolactam monomers which may be represented by the following structural formula:

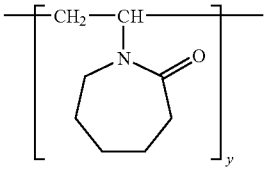

and dimethylaminoethylmethacrylate monomers which may be represented by the following structural formula:

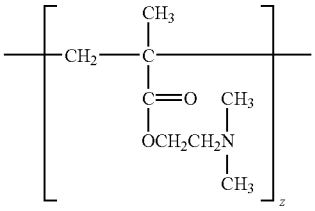

Exemplary vinylpyrrolidone/vinylcaprolactam/ammonium derivative terpolymer wherein the ammonium derivative monomer has 6 to 12 carbon atoms and is selected from diallylamino alkyl methacrylamides, dialkyl dialkenyl ammonium halides, and a dialkylamino alkyl methacrylate or acrylate which find use in the present inventive compositions include those marketed under the tradename ADVANTAGE® (ex. ISP.) as well as GAFFIX® (ex. ISP Corp). Such terpolymers are usually formed by a free-radical polymerization reaction to produce linear random vinylpyrrolidone/vinylcaprolactam/ammonium derivative terpolymers. The vinylpyrrolidone/vinylcaprolactam/ammonium derivative terpolymers useful in the present invention preferably comprise 17-32 weight % vinylpyrrolidone; 65-80 weight % vinylcaprolactam; 3-6 weight % ammonium derivative and 0-5 weight % stearyl methacrylate monomers. The polymers can be in the form of random, block or alternating structure having number average molecular weights ranging between about 20,000 and about 700,000; preferably between about 25,000 and about 500,000. The ammonium derivative monomer preferably has from 6 to 12 carbon atoms and is selected from the group consisting of dialkylaminoalkyl methacrylamide, dialkyl dialkenyl ammonium halide and a dialkylamino alkyl methacrylate or acrylate. Examples of the ammonium derivative monomer include, for example, dimethylamino propyl methacrylamide, dimethyl diallyl ammonium chloride, and dimethylamino ethyl methacrylate (DMAEMA). These terpolymers are more fully described in U.S. Pat. No. 4,521,404 to GAF Corporation, the contents of which are hereby incorporated by reference.

Exemplary film-forming polyvinylalcohols which find use in the present inventive compositions include those marketed under the tradename Airvol® (Air Products Inc., Allentown Pa.). These include: Airvol® 125, classified as a "super hydrolyzed" polyvinylalcohol polymer having a degree of hydrolysis of at least 99.3%, and a viscosity at a 4% solution in 20° C. water of from 28-32 cps; Airvol® 165, and Airvol® 165S, each being classified as "super hydrolyzed" polyvinylalcohol polymer having a degree of hydrolysis of at least 99.3%, and a viscosity at a 4% solution in 20° C. water of from 62-72 cps; Airvol® 103, classified as a "fully hydrolyzed" polyvinylalcohol polymer having a degree of hydrolysis of from 98.0-98.8%, and a viscosity at a 4% solution in 20° C. water of from 3.5-4.5 cps; Airvol® 305, classified as a "fully hydrolyzed" polyvinylalcohol polymer having a degree of hydrolysis of from 98.0-98.8%, and a viscosity at a 4% solution in 20° C. water of from 4.5-5.5 cps; Airvol® 107, classified as a "fully hydrolyzed" polyvinylalcohol polymer having a degree of hydrolysis of from 98.0-98.8%, and a viscosity at a 4% solution in 20° C. water of from 5.5-6.6 cps; Airvol® 321, classified as a "fully hydrolyzed" polyvinylalcohol polymer having a degree of hydrolysis of from 98.0-98.8%, and a viscosity at a 4% solution in 20° C. water of from 16.5-20.5 cps; Airvol® 325, classified as a "fully hydrolyzed" polyvinylalcohol polymer having a degree of hydrolysis of from 98.0-98.8%, and a viscosity at a 4% solution in 20° C. water of from 28-32 cps; and Airvol® 350, classified as a "fully hydrolyzed" polyvinylalcohol polymer having a degree of hydrolysis of from 98.0-98.8%, and a viscosity at a 4% solution in 20° C. water of from 62-72 cps; Airvol® 425, classified as being an "intermediate hydrolyzed" polyvinylalcohol polymer classified having a degree of hydrolysis of from 95.5-96.5%, and a viscosity at a 4% solution in 20° C. water of from 27-31 cps; Airvol® 502, classified as a "partially hydrolyzed" polyvinylalcohol polymer having a degree of hydrolysis of from 87.0-89.0%, and a viscosity at a 4% solution in 20° C. water of from 3.0-3.7 cps; Airvol® 203 and Airvol® 203S, each classified as a "partially hydrolyzed" polyvinylalcohol polymer having a degree of hydrolysis of from 87.0-89.0%, and a viscosity at a 4% solution in 20° C. water of from 3.5-4.5 cps; Airvol® 205 and Airvol® 205S, each, classified as a "partially hydrolyzed" polyvinylalcohol polymer having a degree of hydrolysis of from 87.0-89.0%, and a viscosity at a 4% solution in 20° C. water of from 5.2-6.2 cps; Airvol® 523, classified as a "partially hydrolyzed" polyvinylalcohol polymer having a degree of hydrolysis of from 87.0-89.0%, and a viscosity at a 4% solution in 20° C. water of from 23-27 cps; and Airvol® 540, each classified as a "partially hydrolyzed" polyvinylalcohol polymer having a degree of hydrolysis of from 87.0-89.0%, and a viscosity at a 4% solution in 20° C. water of from 45-55 cps.

Particularly preferred are polyvinyl alcohol polymers which exhibit a degree of hydrolysis in the range of from 87%-89% and which desirably also exhibit a viscosity at a 4% solution in 20° C. water of from 3.0-100.0 cps.

Exemplary cationic cellulose polymers which find use in the present inventive compositions have been described in U.S. Pat. No. 5,830,438 as being a copolymer of cellulose or of a cellulose derivative grafted with a water-soluble monomer in the form of quaternary ammonium salt, for example, halide (e.g., chloride, bromide, iodide), sulfate and sulfonate. Such polymers are described in U.S. Pat. No. 4,131,576 to National Starch & Chemical Company, the contents of which are hereby hydroxyethyl- and hydroxypropylcelluloses grafted with a salt of methacryloylethyltrimethyl ammonium, methacrylamidopropyltrimethyl ammonium, or dialkyldiallyl ammonium, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like. The preferred materials can be purchased for example under the trademarks "Celquat L 200" and "Celquat H 100" from National Starch & Chemical Company.

Useful cationic cellulose polymers are, per se, generally known. Exemplary cationic cellulose polymers useful in the present inventive compositions exhibit generally a viscosity of about 1,000 cps (as taken from a product specification of Celquat H-100; measured as 2% solids in water using an RVF Brookfield Viscometer, #2 spindle at 20 rpm and 21° C.).

A preferred class of materials which find use in the film forming constituent are film forming cationic polymers, an especially film-forming fatty quaternary ammonium compounds which generally conform to the following structure:

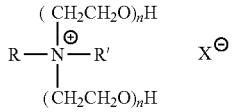

wherein R is a fatty allyl chain, e.g., $C_8$-$C_{32}$ allyl chain such as tallow, coco, stearyl, etc., R' is a lower $C_1$-$C_6$ alkyl or alkylene group, the sum of both n is between 12-48, and X is a salt-forming counterion which renders the compound water soluble or water dispersible, e.g., an alkali, alkaline earth metal, ammonium, methosulfate as well as $C_1$-$C_4$ alkyl sulfates.

A particularly preferred film forming film-forming fatty quaternary ammonium compound may be represented by the following structure:

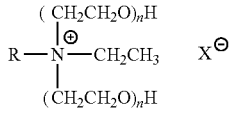

wherein R is a fatty alkyl chain, e.g., $C_8$-$C_{32}$ alkyl chain such as tallow, coco, stearyl, etc., the sum of both "n" is between 12-48, and preferably the value of each n is the same as the other, and X is a salt-forming counterion such as an alkali, alkaline earth metal, ammonium, methosulfate but is preferably an alkyl sulfate such as ethyl sulfate but especially diethyl sulfate. An preferred example of a commercially available material which may be advantageously used is CRODAQUAT TES (ex. Croda Inc., Parsippany, N.J.) described to be polyoxyethylene (16) tallow ethylammonioum ethosfulfate. A further preferred commercially available material is CRODAQUAT 1207 (ex. Croda Inc.), as well as materials marketed as ARQUAD T-50 (ex. Akzo Nobel).

In certain particularly preferred embodiments a film-forming fatty quaternary ammonium compound is necessarily present. While the film-forming, fatty quaternary ammonium compounds may be present in any effective amount, desirably it is present in amounts of from 0.01-10% wt., more desirably from 0.1-5% wt. based on the total weight of the inventive compositions.

A further class of particularly useful film forming materials include film-forming, organosilicone quaternary ammonium compounds. Such compounds may also exhibit antimicrobial activity, especially on hard surfaces which may supplement the effect of the quaternary ammonium surfactant compounds having germicidal properties.

Specific examples of organosilicone quaternary ammonium salts that may be used in the compositions of this invention include organosilicone derivatives of the following ammonium salts: di-isobutylcresoxyethoxyethyl dimethyl benzyl ammonium chloride, di-isobutylphenoxyethoxyethyl dimethyl benzyl ammonium chloride, myristyl dimethylbenzyl ammonium chloride, myristyl picolinium chloride, N-ethyl morpholinium chloride, laurylisoquinolinium bromide, alkyl imidazolinium chloride, benzalkonium chloride, cetyl pyridinium chloride, coconut dimethyl benzyl ammonium chloride, stearyl dimethyl benzyl ammonium chloride, alkyl dimethyl benzyl ammonium chloride, alkyl diethyl benzyl ammonium chloride, alkyl dimethyl benzyl ammonium bromide, di-isobutyl phenoxyethoxyethyl trimethyl ammonium chloride, di-isobutylphenoxyethoxyethyl dimethyl alkyl ammonium chloride, methyl-dodecylbenzyl trimethyl ammonium chloride, cetyl trimethyl ammonium bromide, octadecyl dimethyl ethyl ammonium bromide, cetyl dimethyl ethyl ammonium bromide, octadec-9-enyl dimethyl ethyl ammonium bromide, dioctyl dimethyl ammonium chloride, dodecyl trimethyl ammonium chloride, octadecyl trimethyl ammonium chloride, octadecyl trimethyl ammonium bromide, hexadecyl trimethyl ammonium iodide, octyl trimethyl ammonium fluoride, and mixtures thereof. Other water dispersible salts, such as the acetates, sulfates, nitrates, and phosphates, are effective in place of the halides, but the chlorides and bromides are preferred. The silicone group is preferably substituted with alkyl ethers. Preferred alkyl ethers are short carbon chain ethers such as methoxy and ethoxy substituents.

Still further examples of particularly preferred film-forming, organosilicone quaternary ammonium compounds which find use in the present inventive compositions include those which may be represented by the following structural representation:

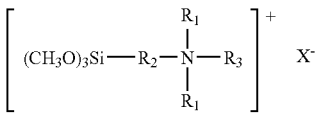

wherein:

$R_1$ and $R_2$ each independently represent short chain alkyl or alkenyl groups, preferably $C_1$-$C_8$ alkyl or alkenyl groups;

$R_3$ represents a $C_{11}$-$C_{22}$ alkyl group; and

X represents a salt forming counterion, especially a halogen.

Preferred short chain alkyl substituents for $R_1$ are methyl and ethyl, preferred short chain alkyl substituents for $R_2$ are straight chain links of methylene groups consisting of from 1 to 4 members, preferred $R_3$ substituents are straight chain links of methylene groups consisting of from 11 to 22 members, and preferred halogens for X are chloride and bromide.

An exemplary particularly preferred and commercially available film-forming, organosilicone quaternary ammonium compounds useful in the inventive compositions is AEM® 5772 or AEM® 5700 (from Aegis Environmental Co., Midland, Mich.). Both of these materials are described as being 3-(trimethoxysilyl)propyloctadecyldimethyl ammonium chloride, AEM® 5700 and is sold as a 72% by weight active solution of the compound in a water/methanol mixture, while AEM® 5772 is sold as a 72% by weight active solution of the compound in a water/methanol mixture. While the film-forming, organosilicone quaternary ammonium compound may be present in any effective amount, desirably it is present in amounts of from 0.01-5% wt., more desirably from 0.05-2.5% wt. based on the total weight of the inventive compositions.

A further material which is contemplated to be useful in the present inventive compositions includes materials currently being sold under the VIVIPRINT tradename, e.g., VIVIPRINT 131, which is described to be 2-propenamide, N-[3-(dimethylamino)propyl]-2-methyl, polymer with 1-ethenyl-2-pyrrolidone hydrochloride.

It is of course contemplated that a mixture or blend of two or more distinct compounds may be used to provide the film forming constituent of the inventive compositions.

In addition to the film forming materials described immediately above, other film forming materials which are compatible with the balance of the constituents present in an inventive composition are also contemplated as being useful and within the scope of the present invention.

Preservatives which do not include a disinfectant component may also be added in minor amounts in the formulations according to the invention. Compositions known in the art may be used. Examples of such preservatives compounds include those which are presently commercially available under the trademarks Kathon® CG/ICP (Rohm & Haas, Philadelphia Pa.), Suttocide® A (Sutton Labs, Chatham N.J.) as well as Midtect® TFP (Tri-K Co., Emerson, N.J.). Such preservatives are generally added in only minor amounts, i.e., amounts of about 0.5% by weight of the total composition, more generally an amount of about 0.1% by weight and less, and preferably present in amounts of about 0.05% by weight and less. Typically such preservative constituents are not necessary in the inventive compositions due to their acidic pH.

The composition provided according to the invention can be desirably provided as a ready to use product in a manually operated spray-dispensing container or in a deformable "squeeze bottle" type dispenser. With regard to the former, such are known to the art and typically comprise a flask or bottle suited for containing a quantity of the liquid composition of the invention which may be dispensed via a manually operated spray pump, while the latter is also known to the art and typically comprises a deformable bottle, typically formed of a synthetic polymer such a polyolefin (e.g., polyethylene, polypropylene, etc.) or a polyalkylene terephthalate from which the liquid composition is expelled, typically via a nozzle, by a user compressing part of the deformable bottle. The latter provides a low cost delivery system and is particularly preferred.

In a yet a further embodiment, the compositions according to the invention may be formulated so that they may be useful in conjunction with an "aerosol" type product wherein they are discharged from a pressurized aerosol container. If the inventive compositions are used in an aerosol type product, it is preferred that corrosion resistant aerosol containers, such as coated or lined aerosol containers be used. Such are preferred as they are known to be resistant to the effects of acidic formulations. Known art propellants, such as liquid propellants as well as propellants of the non-liquid form, i.e., pressurized gases, including carbon dioxide, air, nitrogen, hydrocarbons as well as others may be used.

Whereas the present invention is intended to be used in the types of liquid forms described, nothing in this specification shall be understood as to limit the use of the composition according to the invention with a further amount of water to form a cleaning solution therefrom. In such a proposed diluted cleaning solution, the greater the proportion of water added to form said cleaning solution, the greater may be the reduction of the rate and/or efficacy of the thus formed cleaning solution in the cleaning of a hard surface, as well as a reduction in disinfectant efficacy. Accordingly, longer residence times upon the stain to effect their loosening and/or the usage of greater amounts may be necessitated. Conversely, nothing in the specification shall be also understood to limit the forming of a "super-concentrated" cleaning composition based upon the composition described above. Such a super-concentrated composition is essentially the same as the compositions described above except in that they include a lesser amount of water.

While the cleaning compositions are most beneficial for use in undiluted form, viz., their form as described above, they may also be diluted to form a cleaning composition therefrom. Such cleaning compositions may be easily prepared by diluting measured amounts of the compositions in further amounts of water by the consumer or other end user in certain weight ratios of composition to water, and optionally, agitating the same to ensure even distribution of the composition in the water. The aqueous compositions according to the invention may be used without further dilution, but may also be used with a further aqueous dilution, i.e., in composition to water concentrations of about 1:0 to extremely dilute dilutions such as about 1:10,000, but preferably would be used in a weight or volume ratio proportion of about 1:10 to about 1:100. Generally better results and faster removal are to be expected at lower relative dilutions of the composition and the water.

The compositions according to the invention are easily produced by any of a number of known art techniques. Conveniently, a part of the water is supplied to a suitable mixing vessel further provided with a stirrer or agitator, and while stirring, the remaining constituents are added to the mixing vessel, including any final amount of water needed to provide to 100% wt. of the inventive composition.

Illustrative example compositions which may be produced include those set forth below. The illustrative example compositions demonstrate certain particularly preferred embodiments of the invention as well as preferred weight percentages as well as preferred relative weight percentages/weight ratios with regard to the respective individual constituents present within a composition.

EXAMPLE 1

| constituent | % wt. |
|---|---|
| linear alcohol alkoxylated nonionic surfactant | 0.001-1.5 |
| tallowamine surfactant | 0.2-5 |
| tallowtrimethylammonium chloride (50%) | 0.1-2.5 |
| BEROL 266 | 0.01-3 |
| hydrochloric acid (36%) | 0.5-15 |
| colorant | 0.0001-0.1 |
| fragrance | 0.01-2 |
| water | to 100 |

EXAMPLE 2

| constituent | % wt. |
|---|---|
| linear alcohol alkoxylated nonionic surfacant | 0.001-15 |
| BEROL 266 | 0.01-3 |
| colorant | 0.0001-0.1 |
| fragrance | 0.01-2 |
| formic acid (85%) | 0.1-10 |
| citric acid anhydrous | 0.1-10 |
| hydroxyethylcellulose | 0.01-5 |
| sodium hydroxide (50%) | 0.1-3.5 |
| preservative | 0.0001-1.5 |
| benzalkonium chloride (80%) | 0.01-3 |
| water | to 100 |

EXAMPLE 3

| constituent | % wt. |
|---|---|
| linear alcohol alkoxylated nonionic surfactant | 0.30 |
| BEROL 266 | 0.10 |
| sodium hydroxide (50%) | 2.04 |
| formic acid (85%) | 1.29 |
| citric acid anhydrous | 1.00 |
| hydroxyethylcellulose | 0.45 |
| benzalkonium chloride (80%) | 0.36 |
| fragrance | 0.21 |
| colorant | 0.003 |
| water | to 100 |

EXAMPLE 4

| constituent | % wt. |
|---|---|
| tallowamine surfactant | 1.52 |
| tallowtrimethylammonium chloride (50%) | 0.947 |
| linear alcohol alkoxylated nonionic surfactant | 0.25 |
| BEROL 266 | 0.10 |
| hydrochloric acid (36%) | 18.75 |
| colorant | 0.22 |
| colorant | 0.0062 |
| water | to 100 |

EXAMPLE 5

| constituent | % wt. |
|---|---|
| linear alcohol alkoxylated nonionic surfactant | 0.25 |
| tallowtrimethylammonium chloride (50%) | 0.947 |
| tallowamine surfactant | 1.14 |
| BEROL 266 | 0.10 |
| hydrochloric acid (36%) | 18.75 |
| colorant | 0.0062 |
| colorant | 0.22 |
| water | to 100 |

EXAMPLE 6

| constituent | % wt. |
|---|---|
| tallowamine surfactant | 1.60 |
| tallowtrimethylammonium chloride (50%) | 0.95 |
| linear alcohol alkoxylated nonionic surfactant | 0.255 |
| BEROL 266 | 0.10 |
| hydrochloric acid (36%) | 29.166 |
| terpene alcohol | 0.300 |
| methyl salicylate | 0.038 |
| colorant | 0.00012 |
| colorant | 0.00044 |
| water | to 100 |

EXAMPLE 7

| constituent | % wt. |
|---|---|
| tallowamine surfactant | 1.60 |
| tallowtrimethylammonium chloride (50%) | 0.95 |
| linear alcohol alkoxylated nonionic surfactant | 0.255 |
| BEROL 266 | 0.10 |
| hydrochloric acid (36%) | 29.166 |
| methyl salicylate | 0.038 |
| colorant | 0.00012 |
| colorant | 0.00044 |
| water | to 100 |

EXAMPLE 8

| constituent | % wt. |
|---|---|
| tallowamine surfactant | 1.60 |
| tallowtrimethylammonium chloride (50%) | 0.95 |
| linear alcohol alkoxylated nonionic surfactant | 0.255 |
| BEROL 266 | 0.10 |
| hydrochloric acid 36% | 29.166 |
| colorant | 0.20 |
| colorant | 0.00012 |
| colorant | 0.00044 |
| water | to 100 |

The following Table A identifies the individual constituents described in the foregoing examples.

TABLE A

| Constituent | Identity/Source |
|---|---|
| linear alcohol alkoxylated nonionic surfactant | $C_{12}$-$C_{14}$ linear alcohol ethoxylate, 10 mols ethoxylation, such as Empilan KB10 (C12-C14 alcohol, 10EO), 100% wt., ex. Albright & Wilson or $C_{12}$-$C_{15}$ linear alcohol ethoxylate, 10 mols ethoxylation, |
| tallowamine surfactant | PEG-2 tallowamine; Aminogen T2 |
| tallowtrimethylammonium chloride (50%) | tallowtrimethylammonium chloride, (50%); Arquad T-50, ex. Akzo Nobel |
| BEROL 266 | "narrow range distribution" $C_9$-$C_{11}$ nonionic surfactant with approx. 5.5 mols ethoxylation |
| benzalkonium chloride (80%) | benzalkonium chloride, 80% wt. aqueous solution |
| hydrochloric acid (36%) | hydrochloric acid, 36% wt. aqueous solution |
| formic acid (85%) | formic acid, 85% wt. aqueous solution |
| citric acid anhydrous | citric acid, anhydrous |
| sodium hydroxide (50%) | sodium hydroxide, 50% aqueous solution |
| colorant | dyestuff, or colorant; one or more Cl Acid Blue dye(s) and/or FD&C dye(s) |
| fragrance | proprietary fragrance composition |
| methyl salicylate | methyl salicylate, used as fragrance booster |
| hydroxyethylcellulose | hydroxyethylcellulose |
| terpene alcohol | terpene alcohol (95%-99% wt.) |
| preservative | preservative composition, proprietary |
| water | deionized or "soft" water |

The compositions according to Example 1 illustrate a composition which includes one or more surfactants which provide both a thickening and a cleaning function. The compositions according to Example 2 illustrate a composition which includes a hydroxyethylcellulose thickener constituent.

It is to be understood that one or more of the further optional constituents, including bleach, oxidizing agents, film forming polymers may be added in appropriate amounts to either of the Example formulae.

When applied from a deformable plastic bottle through a nozzle onto the sidewalls of a toilet bowl, each of the foregoing example compositions according to Examples 3-8 exhibited excellent transverse spreading of the lamina of the composition as it was applied to the interior curved surface of toilet bowls, such that the formation of discrete downwardly extending regions of the said cleaning composition, "fingers", having zones or regions between adjacent fingers of the interior surface of the toilet bowl was substantially reduced. Such was particularly surprising as it was observed that while the formation of such fingers was minimized it was also observed that the rate of vertical descent of the cleaning composition was not undesirably accelerated.

The invention claimed is:

1. A largely aqueous, thickened, acidic composition which exhibits a pH of 4 or less, which comprises:

(a) at least one acid;

(b) a thickener system which comprises:

(b1) a film-forming fatty quaternary ammonium compound according to the following structure:

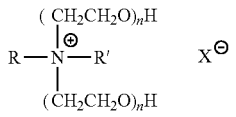

wherein R is a $C_8$-$C_{32}$ alkyl chain, R' is a lower $C_1$-$C_6$ alkyl or alkylene group, the sum of both n is between 12-48, and X is a salt-forming counterion which renders the compound water soluble or water dispersible; and (b2) an alkoxylated primary, secondary or tertiary fatty amine compound;

(c) at least one superwetter surfactant which is based on a narrow range ethoxylated alcohol nonionic surfactant having two cloud points wherein the narrow range ethoxylated alcohol nonionic surfactant having two cloud points is a $C_9$-$C_{11}$ nonionic surfactant characterized by one or more of the following:

(i) having approximately 5.5 mols ethoxylation, and/or (ii) exhibits an HLB value of about 12-12.4, and/or (iii) when dispersed or dissolved at a 1% concentration in water, said narrow range ethoxylated alcohol nonionic surfactant exhibits one cloud point at 24-29° C. and a second cloud point at 55-58° C.; and (d) at least one additional detersive surfactant.

2. A composition according to claim 1 wherein the at least one additional detersive surfactant comprises tallowtrimethylammonium chloride.

3. A composition according to claim 1 wherein the pH of the composition is 1 or less.

4. A composition according to claim 1 wherein the at least one acid is selected from the group consisting of citric acid, formic acid, hydrochloric acid, and mixtures thereof, to the exclusion of other acids.

5. A method for the cleaning of hard surfaces, which method includes the step of applying a cleaning effective amount of a composition according to claim 1 to provide a cleaning benefit.

* * * * *